US011715344B2

(12) United States Patent
Marks et al.

(10) Patent No.: US 11,715,344 B2
(45) **Date of Patent: *Aug. 1, 2023**

(54) MULTI-CABINET GAME BUILD AND GAMING MACHINES USING SAME

(71) Applicant: Aristocrat Technologies Australia Pty Limited, North Ryde (AU)

(72) Inventors: Daniel Marks, Decatur, GA (US); Dinesh Dua, Alpharetta, GA (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 53 days.

This patent is subject to a terminal disclaimer.

(21) Appl. No.: 17/153,012

(22) Filed: Jan. 20, 2021

(65) Prior Publication Data

US 2021/0142614 A1 May 13, 2021

Related U.S. Application Data

(63) Continuation of application No. 16/384,008, filed on Apr. 15, 2019, now Pat. No. 10,930,110.

(60) Provisional application No. 62/659,011, filed on Apr. 17, 2018.

(51) Int. Cl.
*G07F 17/32* (2006.01)

(52) U.S. Cl.
CPC ..... *G07F 17/3223* (2013.01); *G07F 17/3211* (2013.01); *G07F 17/3216* (2013.01); *G07F 17/3267* (2013.01)

(58) Field of Classification Search
None
See application file for complete search history.

(56) References Cited

U.S. PATENT DOCUMENTS

| | | | | |
|---|---|---|---|---|
| 10,930,110 | B2 * | 2/2021 | Marks | G07F 17/3211 |
| 2005/0215325 | A1 * | 9/2005 | Nguyen | G07F 17/3202 463/16 |
| 2009/0124370 | A1 * | 5/2009 | Walkwitz | G07F 17/3244 463/27 |
| 2009/0149253 | A1 * | 6/2009 | Kelly | G07F 17/3211 463/40 |
| 2012/0115564 | A1 * | 5/2012 | Canterbury | G07F 17/34 463/20 |
| 2017/0103607 | A1 * | 4/2017 | Hajduk | G07F 17/3258 |

OTHER PUBLICATIONS

Notice of Allowance dated Oct. 7, 2020 for U.S. Appl. No. 16/384,008 (pp. 1-9).

* cited by examiner

*Primary Examiner* — Peter J Iannuzzi
(74) *Attorney, Agent, or Firm* — McAndrews, Held & Malloy, Ltd.

(57) ABSTRACT

A multi-cabinet game build is disclosed. The multi-cabinet game build includes common game play assets and tailored game play assets. The common game play assets are shared by gaming machines across multiple cabinet types. The tailored game play assets are used by gaming machines of a certain cabinet type. A configuration tool is also disclosed which permits a technician to specify a game build configuration for a gaming machine, which configures the gaming machine to present a game of a multi-cabinet game build using the common game play assets and appropriate tailored game play assets for the gaming machine.

20 Claims, 16 Drawing Sheets

MULTI-CABINET GAME BUILD AND GAMING MACHINES USING SAME

RELATED APPLICATIONS

This application is a continuation of U.S. patent application Ser. No. 16/384,008, filed Apr. 15, 2019, which claims priority to U.S. Provisional Patent Application No. 62/659,011, filed Apr. 17, 2018, the disclosures of which are hereby incorporated by reference herein in their entirety.

BACKGROUND

Electronic gaming machines ("EGMs") or gaming machines provide a variety of wagering games such as slot games, video poker games, video blackjack games, roulette games, video bingo games, keno games and other types of games that are frequently offered at casinos and other locations. Play on gaming machines typically involves a player establishing a credit balance by inputting money or another form of monetary credit, and placing a monetary wager from the credit balance on one or more outcomes of a primary or base game. In many games, a player may qualify for secondary games or bonus rounds by attaining certain winning combinations or triggering events in the base game. Secondary games may provide opportunities to win additional game plays, credits, awards, jackpots, progressives, etc. Awards from winning outcomes are typically credited to the credit balance and presented to the player upon completion of a gaming session such as when the player cashes out.

"Slot" type games often display various symbols arrayed in a row-by-column grid or matrix. Specific matching combinations of symbols along predetermined paths or pay lines through the matrix indicate the outcome of the game. The display typically highlights winning combinations/outcomes for ready identification by the player. Matching combinations and their corresponding awards are usually presented in a "pay-table," which is available to the player for reference. Often, the player may vary a wager to vary a number of active pay lines and/or the amount bet on each activated pay line. By varying the wager, the player may also alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are, therefore, highly regulated. Upon initiation of play, the RNG randomly determines a game outcome and symbols are then selected which correspond to that outcome. Notably, some games may include an element of skill on the part of the player and are, therefore, not entirely random.

Developers of game content for gaming machines typically are constrained by a specific cabinet of a gaming machine. In particular, the specific cabinet may provide specific hardware constraints such as, for example, number of displays, display sizes, display orientations, display resolutions, display aspect ratios, processors, memories, input/output devices, and other hardware. Developers typically hard code the screen configuration, resolution, and orientation (e.g., portrait and landscape) of developed game content. Further, game content may also be specifically designed to take advantage of a given cabinet type and to provide a special game feel. For many players, the special game feel is an essential element for delivering an entertaining and exciting experience, and, in turn, increased revenue for the operator.

Such game content that is hard-coded for a specific cabinet type is specifically not designed for other cabinet configurations or form factors. As such, game content cannot be used on another cabinet type with its unique form factor and hardware configuration, since the game content may lose functionality and game feel due to image scaling and other factors. For example, when game content for a landscape configured cabinet type is transferred to a portrait configured cabinet type, there may be a loss of around two-thirds of actual pixels (i.e., when a 1920×3240 screen configuration made of three 1920×1080 vertically stacked landscape screens is transferred to a 1080×1290 screen configuration). Or, put another way, every four pixels on the landscape configuration has to be reduced to one pixel on the portrait configuration. This results in a loss of image fidelity due to image scale reduction.

This limitation affects the ability of game developers to design and operators to employ a single instance of game content across different cabinet types. Solutions for operating a single instance of game content across multiple cabinet types have not been employed due to complexities arising from a wide range of differing cabinet types having different hardware configurations, like different number of screens, screen sizes, screen orientations, screen resolutions, aspect ratios, processors, memories, input/output devices, and other hardware. Moreover, developers tend to optimize game content and game software to the hardware of a specific cabinet type. In turn, there is decreased utilization of game content across cabinet types.

SUMMARY

An embodiment provides a system and method of configuring a gaming machine. The system and method configure the gaming machine to use a multi-cabinet game build based on a detected configuration of the gaming machine.

Specifically, the system includes a multi-cabinet game build that is operable across gaming machines having multiple cabinet types. The system further includes a configuration tool comprising a user interface configured to define a game build configuration for a gaming machine based on its cabinet type; a non-volatile memory configured to store the defined game build configuration; and a controller configured to determine if the game build configuration matches the cabinet information for the gaming machine, and to initiate a game of the multi-cabinet game build in response to determining that the game build configuration matches the cabinet information for the gaming machine.

The system may utilize a common set of art assets, audio assets, and game play assets (sometimes called common assets) that is deployable across gaming machines with different cabinet types, while at the same time including game content optimized or tailored for the cabinet type of the gaming machine. For example, some art assets, audio assets, and/or game play assets may be unique to the screen orientation (e.g., landscape or portrait orientation) of the cabinet.

DETAILED DESCRIPTION

Figure 1:
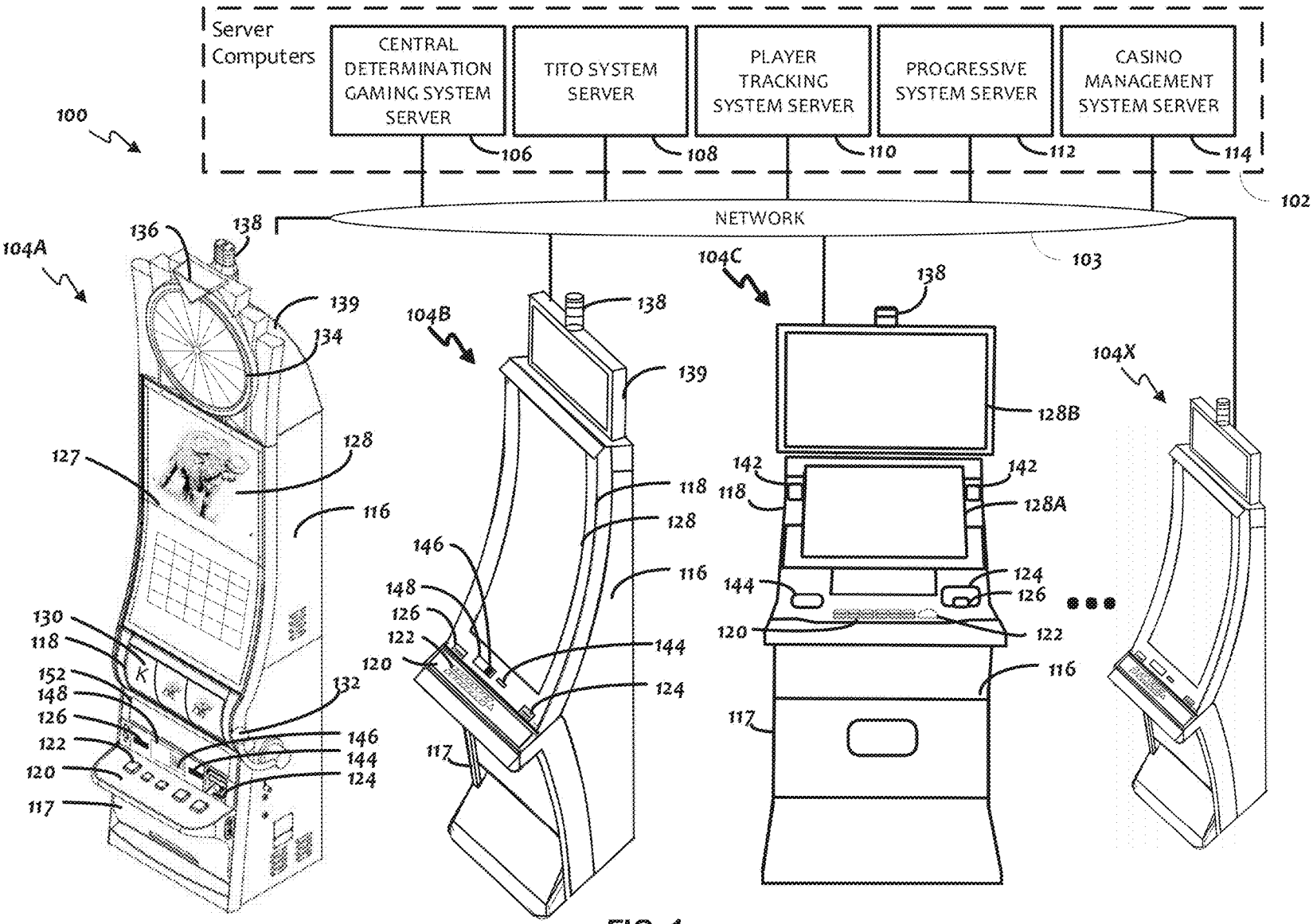
FIG. 1 is an exemplary diagram showing several gaming machines networked with various gaming related servers.

Various aspects of the present disclosure can be embodied in many different forms and should not be construed as being limited to the example embodiments set forth herein. Rather, these example embodiments of the disclosure are provided so that this disclosure will be thorough and complete and will convey various aspects of the disclosure to those skilled in the art.

Per one embodiment, a system is disclosed that attempts to provide a tailored gaming experience to gaming machines having different cabinet types. In general, the system utilizes a common set of art assets, audio assets, and game play assets (sometimes called common assets) that is deployable across gaming machines with different cabinet types. The system further utilizes game content that is optimized or otherwise tailored for a particular cabinet type. For example, some art assets, audio assets, and/or game play assets may be unique to the screen orientation (e.g., landscape or portrait orientation) of the cabinet. Through the use of common assets and tailored assets, a configuration tool can setup a gaming machine to provide a gaming experience that appears to be tailored, optimized, or otherwise specifically designed for the gaming machine and its cabinet type.

To this end, a gaming system is disclose that includes a game build chip, a gaming machine, and a setchip. The gaming machine includes a cabinet having a particular cabinet type, a display device, a non-volatile memory, a removable storage reader, a game controller, and a memory that stores a game program and other instructions.

The setchip includes a configuration tool executable by the game controller after the setchip is coupled to the removable storage reader. Execution of the configuration tool causes the game controller to present a user interface on the display device of the gaming machine. Further execution of the configuration tool causes the game controller to receive selections, via the user interface, that specify a game build configuration for the gaming machine, and store the game build configuration in the non-volatile memory of the gaming machine.

The game build chip stores a multi-cabinet game build of a game. The multi-cabinet game build includes common assets and tailored assets. The common assets are used by gaming machines of different cabinet types. The tailored assets are used by gaming machines of a particular cabinet type. Executing instructions of the memory causes the game controller to select tailored assets per the game build configuration stored in the non-volatile memory and store the selected tailored assets and the common assets to the memory. Executing the game program of the memory causes the game controller to present a game and game outcomes of the game on the display device per the common assets and the tailored assets stored in the memory.

The gaming machines, setchips, and/or game build chips of the present disclosure provide various technical improvements. For example, a gaming establishment such as, for example, a casino commonly operates a vast number of gaming machines that span a variety of different cabinet types and/or hardware configurations. Despite such variety, gaming machines per the present disclosure permit such a gaming establishment to maintain a smaller number and/or types of setchips in order to configure, service, maintain, and/or operate their stable of gaming machines, may be reduced. Likewise, the number and/or types of game build chips, that such a gaming establishment must have available, may also be reduced. Due to the reduced number of setchips and/or game build chips, the time and/or coordination required for technicians to roll out a new game and/or modify an existing game on its stable of gaming machines may also be reduced. Such reductions are likely to result in a gaming environment that is more efficient and thus more profitable to operate.

FIG. 1 illustrates several different models of electronic gaming machines (EGMs) which may be networked to various gaming related servers. Embodiments of the present disclosure may be configured to work as a system 100 in a gaming environment that includes one or more server computers 102 (e.g., slot servers of a casino) that are in communication, via a network 103, with one or more gaming machines 104A-104X (slots, video poker, bingo machines, etc.). The gaming machines 104A-104X may alternatively be portable and/or remote gaming machines such as, but not limited to, a smart phone, a tablet, a laptop, or a game console.

The network 103 between the gaming machines 104A-104X and the server computers 102, and among the gaming machines 104A-104X, may provide direct communications or indirect communications, such as over the Internet through a website maintained by a computer on a remote server or over an online data network including commercial online service providers, Internet service providers, private networks, and the like. In other embodiments, the network 103 may include RF, cable TV, satellite links, and the like which permit the gaming machines 104A-104X to communicate with one another and/or the server computers 102.

In some embodiments, server computers 102 may not be necessary and/or preferred. For example, the present invention may, in one or more embodiments, be practiced on a stand-alone gaming machine such as gaming machine 104A, gaming machine 1048, or any of the other gaming machines 104C-104X. However, it is typical to find multiple gaming machines connected to one or more of the different server computers 102 described herein via network 103.

The server computers 102 may include a central determination gaming system server 106, a ticket-in-ticket-out (TITO) system server 108, a player tracking system server 110, a progressive system server 112, and/or a casino management system server 114. Gaming machines 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over network 103 to any of a group of remote terminals or gaming machines 104A-104X that utilize the game outcomes and display the results to the players.

Gaming machine 104A is often of a cabinet construction which may be aligned in rows or banks of similar devices for placement and operation on a casino floor. The gaming machine 104A often includes a door 117 which provides access to the interior of the cabinet. Gaming machine 104A typically includes a button area or button deck 120 accessible by a player that is configured with input switches or buttons 122, an access channel for a currency acceptor 124, and/or an access channel for a ticket-out printer 126.

In FIG. 1, gaming machine 104A is shown as a RELM XL™ model gaming machine manufactured by Aristocrat® Technologies, Inc. As shown, gaming machine 104A is a reel machine having a gaming display area 127 comprising a number (typically 3 or 5) of mechanical reels 130 with various symbols displayed on them. The mechanical reels 130 are independently spun and stopped to show a set of symbols within the gaming display area 127 which may be used to determine an outcome to the game.

In many configurations, the gaming machine 104A may have a primary display 128 (e.g., video display monitor) mounted to, or above, the gaming display area 127. The primary display 128 may be of a variety of types, e.g., high-resolution LCD, plasma, LED, or OLED panel which may be flat or curved as shown, a cathode ray tube, or other conventional electronically controlled video monitor. Moreover, the primary display 128 may be one or more various orientations (i.e., landscape or portrait), aspect ratios, and resolutions.

In some embodiments, the currency acceptor 124 may also function as a "ticket-in" reader that allows the player to use a casino issued credit ticket to load credits onto the gaming machine 104A (e.g., in a cashless ticket ("TITO") system). In such cashless embodiments, the gaming machine 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming machine 104A.

In some embodiments, the gaming machine 104A includes a player tracking interface 143 for reading, receiving, entering, and/or displaying player tracking information. To this end, the player tracking interface 143 may include a card reader 144, a transceiver 145, a keypad 146, and an illuminated display 148. See, FIG. 2. In such embodiments, a game controller 150 (FIG. 2) within the gaming machine 104A may communicate with the player tracking system server 110 to send and receive player tracking information.

Gaming machine 104A may also include a topper display 139. When bonus play is triggered (e.g., by a player achieving a particular outcome or set of outcomes in the primary game), a bonus topper wheel 134 of the topper display 139 is operative to spin and stop with indicator arrow 136 indicating the outcome of the bonus game. Bonus topper wheel 134 is typically used to play a bonus game, but it could also be incorporated into play of a base or a primary game.

A candle 138 may be mounted on the top of gaming machine 104A and may be activated by a player (e.g., using a switch or one of buttons 122) to indicate to operations staff that gaming machine 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, bet denominations (e.g., $0.25 or $1), pay lines, pay tables, and/or various game related graphics. In some embodiments, the information panel(s) 152 may be implemented as an additional video display.

Gaming machines 104A have traditionally also included a handle 132 typically mounted to the side of cabinet 116 which may be used to initiate game play.

Figure 2:
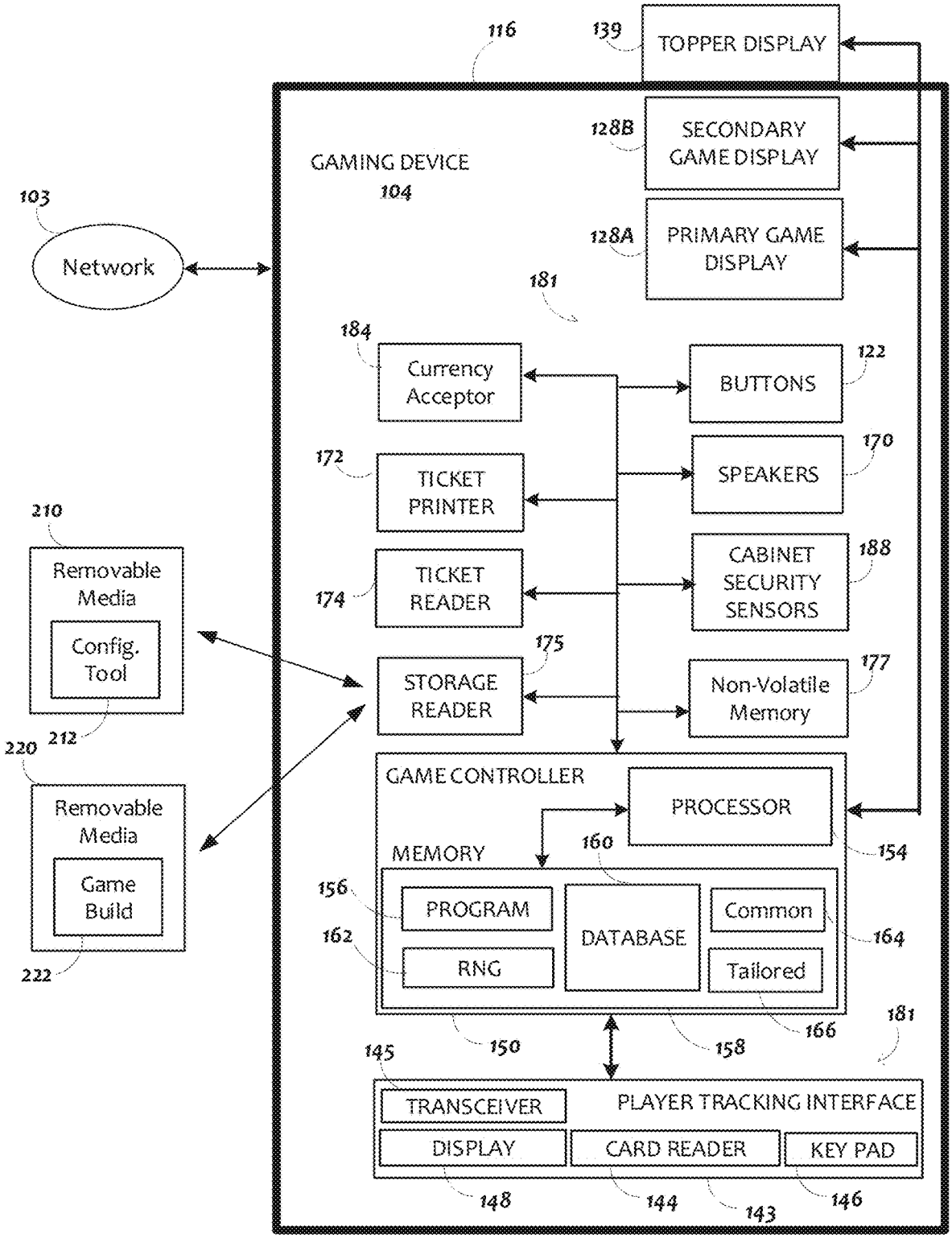
FIG. 2 is a block diagram of an exemplary gaming machine.

Many or all the above described components may be controlled by circuitry (e.g., a gaming controller) housed inside the cabinet 116 of the gaming machine 104A, the details of which are shown in FIG. 2.

Note that not all gaming machines suitable for implementing embodiments of the present invention necessarily include topper displays, information panels, cashless ticket systems, and/or player tracking systems. Further, some suitable gaming machines have only a single game display that includes only a mechanical set of reels and/or a video display, while others are designed for bar counters or table tops and have displays that face upwards.

An alternative example gaming machine 1048 illustrated in FIG. 1 is the Arc™ model gaming machine manufactured by Aristocrat® Technologies, Inc. Note that, where possible, reference numerals identifying similar features of the gaming machine 104A embodiment are also identified in the gaming machine 1048 embodiment using the same reference numbers. Gaming machine 104B does not include physical reels and instead shows game play functions on primary display 128. An optional topper display 139 may be used as a secondary or additional game display for bonus play, to show game features or attraction activities while a game is not in play, or any other information or media desired by the game designer or operator. In some embodiments, topper display 139 may also or alternatively be used to display progressive jackpot prizes available to a player during play of gaming machine 1048.

Example gaming machine 1048 includes a cabinet 116 including a door 117 which opens to provide access to the interior of the gaming machine 1048. The door 117 is typically used by service personnel to refill the ticket-out printer 126 and collect currency collected by currency acceptor 124. The door 117 may also be accessed to reset the machine, verify and/or upgrade the software, and for general maintenance operations. In particular, the door 117 may be used to access a removable storage reader in order to upgrade, install, or configure a game using a configuration tool 212 of a first removable storage media or setchip 210 and a multi-cabinet game build 222 of a second removable storage media or game build chip 220. See, e.g., FIG. 2.

Another example gaming machine 104C shown is the Helix™ model gaming machine manufactured by Aristocrat® Technologies, Inc. Gaming machine 104C includes a primary display 128A that is in a landscape orientation. Although not illustrated by the front view provided, the landscape-style primary display 128A may have a curvature radius from top to bottom, or alternatively from side to side. In some embodiments, primary display 128A is a flat panel display. The primary display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming machines 104A-104C and other similar gaming machines. Each gaming machine may also be operable to provide many different games. Games may be differentiated according to themes, sounds, graphics, type of game (e.g., slot game vs. card game vs. game with aspects of skill), bet denomination, number of pay lines, maximum jackpot, progressive or non-progressive, bonus games, and may be deployed for operation in Class 2 or Class 3 gaming environments, etc.

FIG. 2 is a block diagram depicting components of a gaming machine 104. Gaming machine 104 is generally representative of gaming machines 104A-X depicted in FIG. 1. Where possible, reference numerals identifying features similar to those presented in FIG. 1 are also identified in FIG. 2 using the same reference numbers.

As shown, the gaming machine 104 includes a game controller 150, which generally controls and implements the game or games available for play on the gaming machine 104. To this end, the game controller 150 includes one or more processors 154 configured to execute instructions of a game program 156 stored in a memory 158. The memory 158 may include random access memory (RAM), read only memory (ROM), mass storage devices, hardware registers and/or another form of storage media that are housed within gaming machine 104. In general, the memory 158 may store instructions for execution by the processor 154 and/or data processed by the processor 154. In particular, memory 158 may store one or more databases 160, common assets 164, and tailored assets 166 used by the game program 156. The processor 154 of the game controller 150 may execute game program 156 and/or video streaming software to present a game and its outcomes on displays 128A, 128B of gaming machine 104.

As also shown, the gaming machine 104 may include non-volatile memory 177 for storing instructions and/or data. In some embodiment, the non-volatile memory 177 may be implemented as part of the memory 158. The non-volatile memory 177 may include flash memory storage devices, magnetic memory storage devices, and/or other read/writable storage devices capable of retaining its stored contents even after electric power is removed. As explained below, the non-volatile memory 177 may store a game build configuration used to configure the gaming machine 104 for presenting a game of a multi-cabinet game build 222. In some embodiments, the non-volatile memory 177 may store one or more common and/or tailored assets of a multi-cabinet game build.

The game controller 150 further includes a random number generator (RNG) 162 that may be implemented in hardware and/or software. The game controller 150 may use the RNG 162 to generate game outcomes that comply with regulations for a game of chance. Alternatively, a remote gaming system server such as a central determination gaming system server 106 of FIG. 1 may generate game outcomes for gaming machine 104. In particular, the remote gaming system server may communicate the generated game outcomes to the gaming machine 104 via the network 103. The gaming machine 104 may then display the received game outcomes.

The gaming machine 104 may include a topper display 139 (e.g., a topper wheel, a topper screen, etc.) which sits above cabinet 116. The cabinet 116 and/or topper display 139 may also house a number of other components which may be used to add features to a game played on gaming machine 104. For example, the cabinet 116 or topper display 139 may include speakers 170, a ticket printer 172, a ticket reader 174, a removable storage reader 175, a player interface 181, a currency acceptor 184, and cabinet security sensors 188, which are each coupled to and operable under the control of game controller 150.

The ticket printer 172 may be used to print tickets for a TITO system server 108. In particular, the ticket printer 172 may print bar-coded tickets or other media or mechanisms for storing or indicating a player's credit value. The ticket reader 174 may read bar-coded tickets or other media or mechanisms for storing or indicating a player's credit value. The currency acceptor 184 may collect various forms of currency such as coins, tokens, paper money, etc., which may or may not have an associated monetary value, and may establish a credit balance based on the collected currency. The cabinet security sensors 188 may detect unauthorized opening, moving, tilting, etc. of panels of the cabinet 116, doors 117 of the cabinet 116, and/or the cabinet 116 itself.

The removable storage reader 175 may read removable storage media. In particular, the removable storage reader 175 may read one or more types of inserted flash memory devices such as, for example, CompactFlash (CF) cards, PCMCIA (Personal Computer Memory Card International Association) cards, Secure Digital (SD) cards, MultiMediaCard (MMC) cards, Sony™ memory stick, USB (Universal Serial Bus) thumb drives, etc. The removable storage reader 175 may read one or more types of inserted optical storage media such as, for example, Compact Discs (CDs), Digital Versatile Discs (DVDs), Blu-ray Discs (BDs), etc. The removable storage reader 175 may also read other types of media, such as portable hard drives, solid state drives (SSDs), magnetic hard drives via an interface, such as Universal Serial Bus (USB) interface, Serial ATA (SATA) interface, and others. Moreover, the removable storage reader 175 may support one or more types of attached magnetic storage media such as, for example, magnetic tape, floppy disk, portable hard disk drives, etc. In some embodiments, the removable storage reader 175 is inaccessible to unauthorized personnel. For example, the removable storage reader 175 may be contained within the cabinet 116 and only accessible via a panel or door 117 of the cabinet 116 that must be unlocked and/or removed in order to access the removable storage reader 175.

The removable storage reader 175 may permit authorized personnel (e.g., a technician) to insert a first removable storage media or setchip 210 and a second removable storage media or game build chip 220. The setchip 210 may store a configuration tool 212 that permits authorized personnel to manage and configure a gaming machine 104 to use a multi-cabinet game build 222 of the game build chip 220. To this end, the configuration tool 212 of the setchip 210 includes game build information that specifies the possible configuration options for the multi-cabinet game build 222.

Figure 3A:
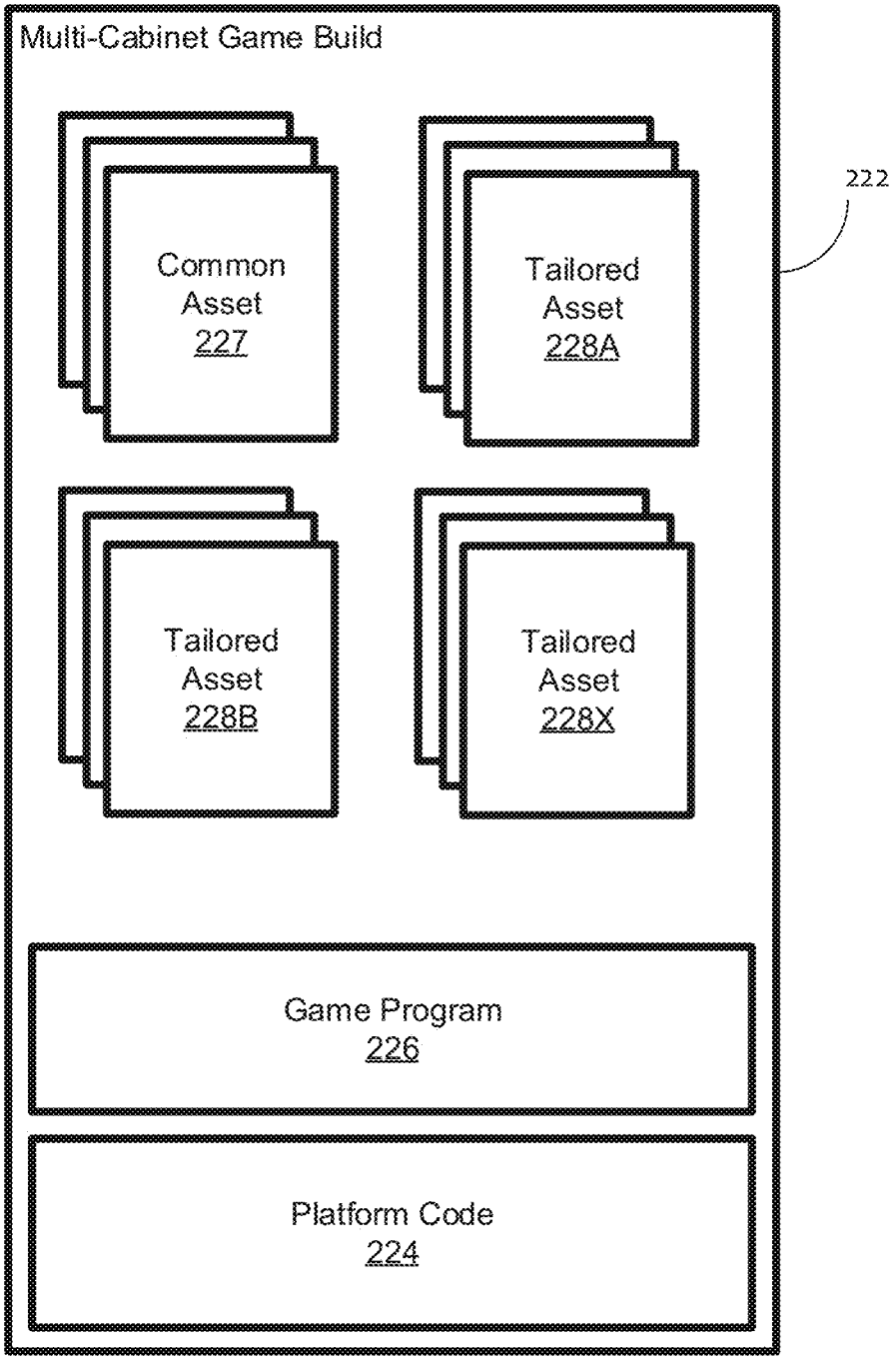
FIG. 3A illustrates contents of an exemplary multi-cabinet game build.

As shown in FIG. 3A, the multi-cabinet game build 222 of the game build chip 220 may include common assets 227 that are shared or common across gaming machines 104 of various cabinet types and sets of tailored assets 228A-228X that are specific to gaming machines 104 of certain cabinet types (e.g., landscape or portrait configuration). In other embodiments, each gaming machine 104 may include the common assets 227 that are usable across multiple cabinet-types. In such embodiments, the multi-cabinet game build 222 may include the sets of tailored assets 228A-228X, which are specific to the cabinet types, but may not include the common assets 227. Moreover, while certain embodiments of a gaming machine may utilize a multi-cabinet game build 222 stored to a removable storage media such as game build chip 220, other embodiments of a gaming machine may utilize a multi-cabinet game build 222 stored to a non-removable storage media of the gaming machine or stored to storage media of a gaming server that is in communication with the gaming machine via a wired and/or wireless network.

The player interface 181 may include various input and/or output devices, which enable a player and/or authorized personnel to interact with the gaming machine 104. For example, the player interface 181 may include a player tracking interface 143, buttons 122, a primary display 128A, and a secondary display 128B, which are each coupled to and operable under the control of game controller 150. The player tracking interface 143 may include a transceiver 145 for wireless communication with a player's smartphone or other portable communication device, keypad 146 for entering information, a player tracking display 148 (e.g., an illuminated or video display) for displaying information, and a card reader 144 for receiving data and/or communicating information to and from a loyalty club card. The player may make selections and otherwise interact with a game of the gaming machine 104 using the buttons 122 or other input devices of the player interface 181. In some embodiment, the primary display 128A and/or secondary display 128B may include a touch screen or some other device, which enables a player to input information into the gaming machine 104 by touching, pressing, and/or otherwise interacting with items displayed via the displays 128A, 128B.

The gaming machine 104 may be connected over network 103 to player tracking system server 110. See, FIG. 1. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 143 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming machines, such as gaming machines 104A-104X, are highly regulated to ensure fairness and, in many cases, gaming machines 104A-104X are operable to award monetary awards (e.g., typically dispensed in the form of a redeemable voucher). Therefore, to satisfy security and regulatory requirements in a gaming environment, hardware and software architectures are implemented in gaming machines 104A-104X that differ significantly from those of general-purpose computers. Adapting general purpose computers to function as a gaming machine 104 is not simple or straightforward because of: 1) the regulatory requirements for gaming machines, 2) the harsh environment in which gaming machines operate, 3) security requirements, 4) fault tolerance requirements, and 5) the requirement for additional special purpose components enabling functionality of a electronic gaming machine. These differences require substantial engineering effort with respect to game design implementation, hardware components, and software.

When a player wishes to play the gaming machine 104, they may establish a credit balance on the gaming machine via a credit input mechanism such as, for example, the card reader 144, the ticket reader 174, or the currency acceptor 182. In particular, the player may establish a credit balance by inserting a loyalty club card into the card reader 144 of the player tracking interface 143, inserting a ticket voucher into the ticket reader 174, and/or inserting currency (e.g., bills, coins, tokens) into the currency acceptor 184. The player may use the credit balance to place wagers on the game and the gaming machine 104 may credit awards based on the outcome of winning instances to the credit balance. In particular, the game controller 150 may decrease the credit balance by the amount of each wager and increase the credit balance by the amount of an award. Moreover, the gaming machine 104 may permit the player to add additional credits to the balance at any time before, after, or during a gaming session. During the game, the player may view game outcomes on the displays 128A, 128B, which may also present other game and prize information.

For each play of the game, the gaming machine 104 may permit a player to make selections that affect the game. For example, the player may vary the total amount wagered by selecting an amount to bet per pay line and the number of lines to play. In many games, the player is asked to initiate or select options during course of game play such as, for example, spinning a wheel to begin a bonus round or select various items during a feature game. The player may make these selections using the buttons 122, the primary display 128A, which may be a touch screen, or using some other device of the player interface 181, which enables a player to input information into the gaming machine 104.

During certain game events, the gaming machine 104 may display visual and auditory effects that may be perceived by the player. These effects add to the excitement of a game, which makes a player more likely to enjoy the playing experience. Auditory effects include various sounds that are projected by the speakers 170. Visual effects include flashing lights, strobing lights or other patterns displayed from lights on the gaming machine 104 or from lights behind the information panel 152 (FIG. 1).

When the player is done, they cash out the credit balance. Typically, a player may cash out by pressing a cash out button to receive a ticket from the ticket printer 172. The ticket may be "cashed-in" for money or inserted into another machine to establish a credit balance for play.

Referring back to FIG. 1, the gaming system 100 includes gaming machines of multiple cabinet types. Types of cabinets for gaming system 100, for example, may include one or more of: gaming machine 104A, which is a RELM XL™ model gaming machine; gaming machine 104B, which is an Arc™ model gaming machine; and gaming machine 104C, which is a Helix™ model gaming machine. A person of skill in the art appreciates that other gaming cabinet types, including from other vendors, are contemplated for use in system 100.

The cabinet types of the gaming machines 104A-104X in FIG. 1 differ in hardware setup. For example, the Arc™ model gaming machine may include a portrait style 46" curved high-definition LCD touch screen, 5.1 stereo surround sound, and dynamic LCD buttons. Some other Arc™ model gaming machines may include dual, portrait style 42" curved, high-definition LCD touch screens. In contrast, for example, some Helix™ model gaming machines may include a floating 23" high definition landscape style monitor and a 32" floating high definition landscape style LCD top monitor with frameless borders, a quad sound package with subwoofer, and programmable LCD button deck. Some other Helix™ model gaming machines may include landscape-style, high definition 27" monitors and a virtual button deck.

Other cabinets that have landscape style displays include, but are not limited to, the Viridian™ model gaming machine manufactured by Aristocrat® Technologies, Inc. Yet other cabinets that have portrait style displays include, but are not limited to, the Behemoth™ model gaming machine manufactured by Aristocrat® Technologies, Inc. A person of skill in the art will appreciate that a combination of portrait and landscape displays in one cabinet are contemplated.

Cabinet types may differ in several ways. For example, the gaming machines 104A-104X differ in such things as the number of displays, display sizes, display orientations, display resolutions, display aspect ratios, processors, memories, input/output devices, other hardware and/or gaming interface configurations. Alone or in combination, these differences present hurdles to game developers attempting to utilize game content that is currently hard coded on the game side for the specific cabinet type.

Embodiments of the present invention allow for a multi-cabinet game build 222 to be deployed across a range of different cabinet types, i.e., a range of cabinet form-factors (e.g., Viridian™, Helix™, Helix+™, Helix XT™, Arc™, Behemoth™, and cabinets of other types), appliances (e.g., televisions, personal computers, home theaters, smart refrigerators, etc.), and mobile devices (e.g., handheld computers, smartphones, tablets, smartwatches, laptops, wearable devices, media players, personal digital assistants, calculators, ultra-mobile personal computers, digital still cameras, digital video cameras, foldable displays, flexible devices, global positioning systems, projectable devices, etc.), regardless of whether the respective displays differ in display size, display resolution, and aspect ratios, for example.

Each of the different cabinets, appliances, and mobile devices, may be configured to present a game of a multi-cabinet game build 222. In particular, as shown in FIG. 3A, the multi-cabinet game build 222 may include platform code 224, a game program 226, common assets 227, and sets of tailored assets 228A-228X. The platform code 224 may provide virtual machines, application programmable interface libraries, and/or other instructions that provide a standard environment in which to execute the game program 226. In particular, the platform code 224 may provide interfaces via which the game controller 150 may obtain cabinet information that describes hardware capabilities of the gaming machine 104A-104X and/or the cabinet type of the gaming machine 104A-104X. While shown as part of the multi-cabinet game build 222, in some embodiments the platform code 224 may remain resident in the various gaming machines 104A-104X and may not be part of the multi-cabinet game build 222.

In some embodiments, the custom assets 227 and tailored assets 228A-228X are stored to a file system of the game build chip 220. For example, the common assets 227 may be stored to a default location (e.g., a default directory) and each set of tailored assets 228A-228X may be stored to a location (e.g., directory) associated with a specific cabinet type to which the assets are applicable. In some embodiments, the directories, to which the common assets 227 and tailored assets 228A-228X are stored, have directory names that are descriptive of or that otherwise identify to which cabinet types the assets within the directory are applicable.

In this manner, a gaming machine 104A-104X may retrieve an asset by first checking a directory associated with its specific cabinet type. If the asset is found in the directory for its cabinet type, the gaming machine 104A-104X may retrieve the asset from the directory. If the asset is not found in the directory for its cabinet type, then the gaming machine 104A-104X may retrieve the asset from a default directory. In this manner the gaming machine 104A-104X may retrieve and use a tailored asset 228A-228X if found in the directory for its cabinet type and may fallback to retrieving and using a common asset 227 from the default location if a tailored asset 228A-228X is not present in the directory for its specific cabinet type. As such, the game program 226, in some embodiments, may specify assets in an agnostic manner (e.g., asset1) while still enabling the gaming machine 104A-104X to locate and load assets that are tailored for its cabinet type.

While the above embodiment utilized a directory structure to organize and identify the respective common assets 227 and tailored assets 228A-228X, other techniques for storing and retrieving the assets 227, 228A-228X are contemplated. For example, the assets 227, 228A-228X may be stored as files to a file system. Each file may be given a filename that is descriptive of or that otherwise identifies to which cabinet type the asset stored in the file is applicable. Such a manner of storing assets 227, 228A-228X may permit the gaming machines 104A-104X to retrieve the applicable assets from the game build chip 220 based on the descriptive names of the files. For example, a common or default asset may be stored with a name asset1.gif and tailored versions of the asset may be stored at asset1widescreen.gif, asset1portrait.gif, etc. Thus, when the game program 226 calls for asset1, the gaming machine 104A-104X may locate and load the file for the version of asset1 that is appropriate for the gaming machine 104A-104X. In this manner, the game program 226 may specify assets in an agnostic manner (e.g., asset1) while still enabling the gaming machine 104A-104X to locate and load assets that are tailored for its cabinet type.

In other embodiments, the assets 227, 228A-228X may be stored in a database of the game build 222 in a manner which enables the gaming machine 104A-104X to query the database for assets tailored to its cabinet type. If the database contains such a tailored asset, then the gaming machine 104A-104X can retrieve it from the database. If the database lacks such a tailored asset, then the gaming machine 104A-104X can retrieve a corresponding common asset 227 from the database.

The common assets 227 may include common artwork assets, common audio assets, common game play assets, and/or other common assets that may be shared across different types of cabinets 116. Conversely, each set of tailored assets 228A-228X may include tailored artwork assets, tailored audio assets, tailored game play assets, and/or other tailored assets that are specific to a particular type of cabinet 116 (e.g., landscape or portrait configuration). By providing both common assets 227 and sets of tailored assets 228A-228X, the game program 226 may be implemented without hard coding for a specific cabinet type (e.g., display configuration, display orientation, etc.) Instead, the game program 226 may be implemented such that the game program 226 uses common assets 227 as well as tailored assets 228A-228X for a specific cabinet type in order to provide a gaming experience tailored to the gaming machine 104A-104X executing the game program 226.

The multi-cabinet game build 222 may include a particular artwork asset in a variety of different graphic file formats (e.g., Graphics Interchange Format (GIF), Bitmap (BMP), Portable Network Graphics (PNG), Joint Photographic Experts Group (JPEG), etc.). Moreover, the multi-cabinet game build 222 may include the particular artwork asset in a variety of different resolutions (e.g., 1920×1080, and 1680×1050) and/or color depths (e.g., 8-bit, 16-bit, 24-bit, etc.) Similarly, the multi-cabinet game build 222 may include a particular audio asset in a variety of different audio file formats (e.g., MPEG-1 Audio Layer III (MP3), Ogg, Waveform Audio File Format (WAV), etc.) and/or bit rates.

The multi-cabinet game build 222 may further include common game play assets and tailored game play assets. In one embodiment, the common and tailored game play assets are stored as Extensible Markup Language (XML) files. Each XML file for a common game play asset may specify particular game play feature values that are common across cabinet types. Each XML file for a tailored game play asset may specify particular game play feature values for an associated cabinet type. In this manner, the multi-cabinet game build 222, via such XML files, may vary various game play features based on the cabinet type of the gaming machine 104A-104X executing the game program 226. For example, a set of tailored XML files or assets 228A-228X may be defined for a slot machine or reel-type game, that specify base game reelstrips and/or bonus game reelstrips, that are dependent upon the cabinet type of the gaming machine 104A-104X executing the reel-type game. In particular, the number, the graphical depictions, and/or the order of symbols may be varied based on the cabinet type. For example, a gaming machine 104 having a portrait orientation may utilize reelstrips with a greater number of symbols per a strip than a gaming machine 104 having a landscape orientation. Further, one or more of the XML files may also specific the number of symbol display positions per reel and the quantity of reels.

In various embodiments, the common game play asset files and/or the tailored game play asset files may specify other game play configurable data such as, bet amounts, wager denominations, wager currency, bet configuration, minimum wager amount, maximum wager amount, award amounts (such as bonus awards, progressive awards, jackpot awards), quantity and type of symbols of symbols or random trigger required to trigger a free play or bonus play, number of reels for the game, number of symbol display positions per reel for each game, reel layout (such as 3×4×5×4×3), pay evaluation (paylines or ReelPower™), reelstrips to use for one or more free spin games, quantity of the free spins if predetermined, and/or any other configuration option for game play.

Similarly, a set of tailored assets 228A-228X may be defined which specify base game paytables and bonus game paytables for the game. Other game play aspects may also be tailored via such XML files. For example, weighted tables used to trigger jackpots, feature games, bonus games, mystery bonuses, progressives, etc. may be tailored for specific cabinets. Moreover, other game play features such as jackpot options, number of free games awarded, a range of multiplier to number of free games for selection (See, e.g. FIG. 7A), a range of a number of symbol rows to number of free games for selection (See, e.g., FIG. 7B), game messages and their supported natural languages, lighting displays (e.g., varying the manner lighting along edges of the gaming machine is illuminated), etc. can be tailored and defined by common assets 227 and/or tailored assets 228A-228X.

Finally, while the above embodiment defines common and tailored game play assets via XML files, other techniques are contemplated for specifying common and/or tailored game play assets. For example, the game play assets may be defined by files having other file formats (Comma-Separated Values (CSV), YAML Ain't Markup Language (YAML), JavaScript Object Notation (JSON), a custom text file format, a custom binary file format, a database file, etc.)

In some embodiments, the tailored assets 228A-228X for the specific cabinet configuration may include content for a high definition landscape portrait configuration (e.g., for individual landscape screens 1920×1080) and for a widescreen landscape portrait configuration (e.g., for individual landscape screens 1680×1050). One way to approach the development of a multi-cabinet game build 222 is to use the landscape orientation as the baseline and equate the high definition landscape portrait configuration and a widescreen landscape portrait configuration to three screens stacked vertically so that multi-cabinet game builds 222 may be authored based on that condition.

Figure 3B:
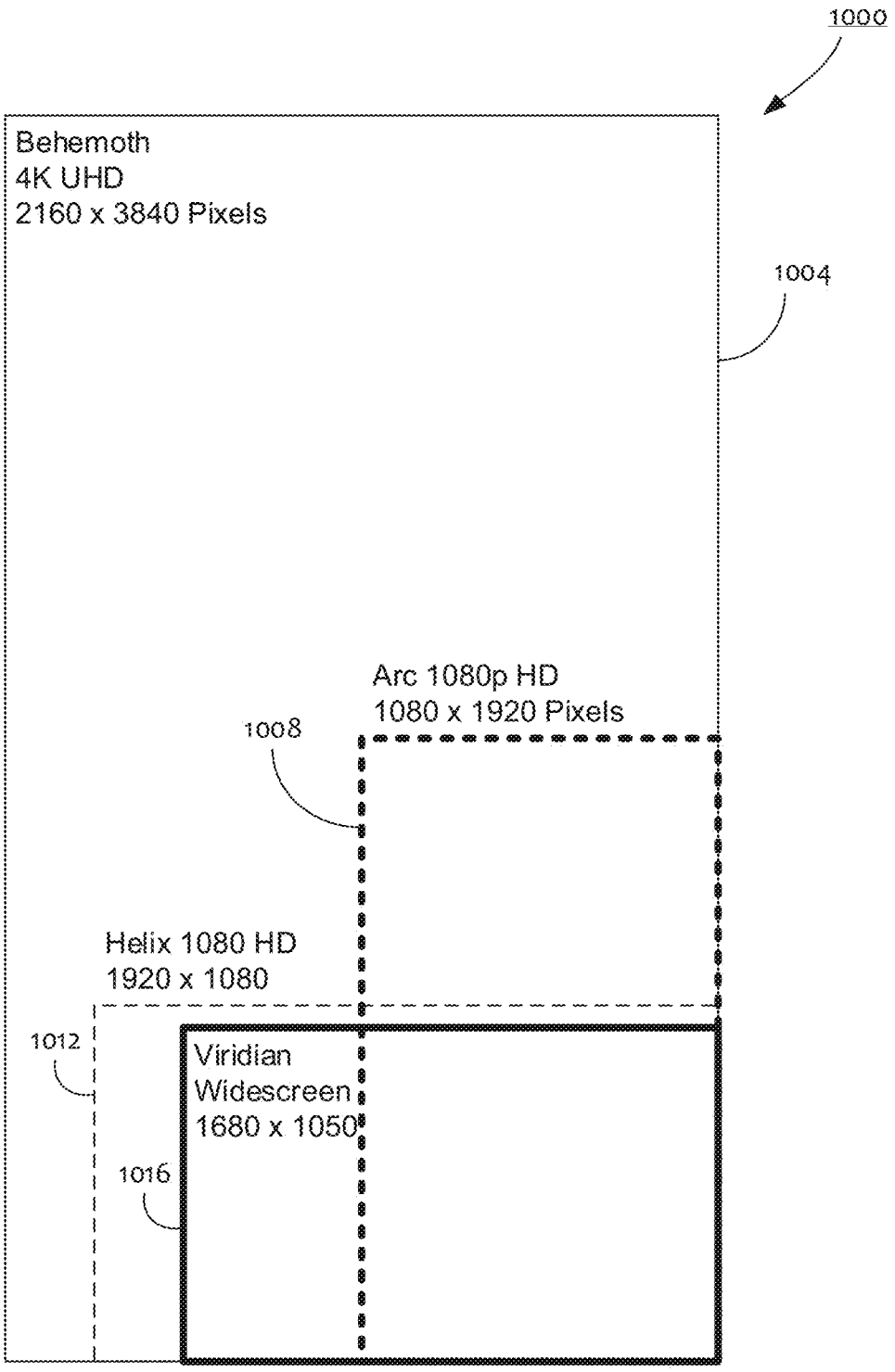
FIG. 3B illustrates a comparison of relative aspect ratios for gaming machines of various cabinet types.

FIG. 3B illustrates a comparison of various displays of various cabinet types having different relative aspect ratios. For example, display 1004, represented in FIG. 3B by the thin solid line, represents a portrait-style display for a Behemoth™ UHD (2160p) display having a screen resolution of 2160×3840 pixels. Display 1008, represented in FIG. 3B by the thick dashed line, represents a portrait-style display for an Arc™ HD (1080p) display having a screen resolution of 1080×1920 pixels. Display 1012, represented in FIG. 3B by the thin dashed line, represents a landscape-style display for a Helix™ HD (1080p) display having a screen resolution of 1920×1080 pixels. Display 1016, represented in FIG. 3B by the thick solid line, represents a landscape-style display for a Viridian™ widescreen (WS) display having a screen resolution of 1680×1050 pixels.

A multi-cabinet game build 222 of the kind disclosed by embodiments herein may be mapped to both landscape and portrait orientations, and may take into account for vertical stacking of displays (e.g., stacking two displays vertically, or stacking three displays vertically where the topper display 139 is included). The game controller 150, via execution of the platform code 224 and/or game program 226, may horizontally and vertically scale (e.g., reduce, increase or stay the same), depending on whether the game is native or non-native to the cabinet type, appliance type, or mobile device type, to accommodate the display configuration of the cabinet type on which the multi-cabinet game build 222 is being installed. Multi-cabinet game builds 222 typically would account for the situation where the topper displays 139 are not included in a cabinet 116 (e.g., not including game critical items on optional displays, like the topper display).

As a person of skill in the art will appreciate, use of common assets 227 and tailored assets 228A-228X may result in a multi-cabinet game build 222 that requires or consumes more storage space on the game build chip 220 than a game build specifically designed for a single type of gaming machine 104A-104X. As such, various forms of content compression may be employed (e.g., Bink2) to maintain or reduce the amount of storage space consumed by the multi-cabinet game build 222. For some embodiments, only the common and tailored assets used by a particular gaming machine 104A-104X are transferred from the game build chip 220 to the gaming machine 104A-104X. Thus, while the use of common assets 227 and tailored assets 228A-228X may increase storage space requirements of the game build chip 220, storage space requirements of the gaming machine 104A-104X may be unaffected or negligibly affected.

Figure 3C:
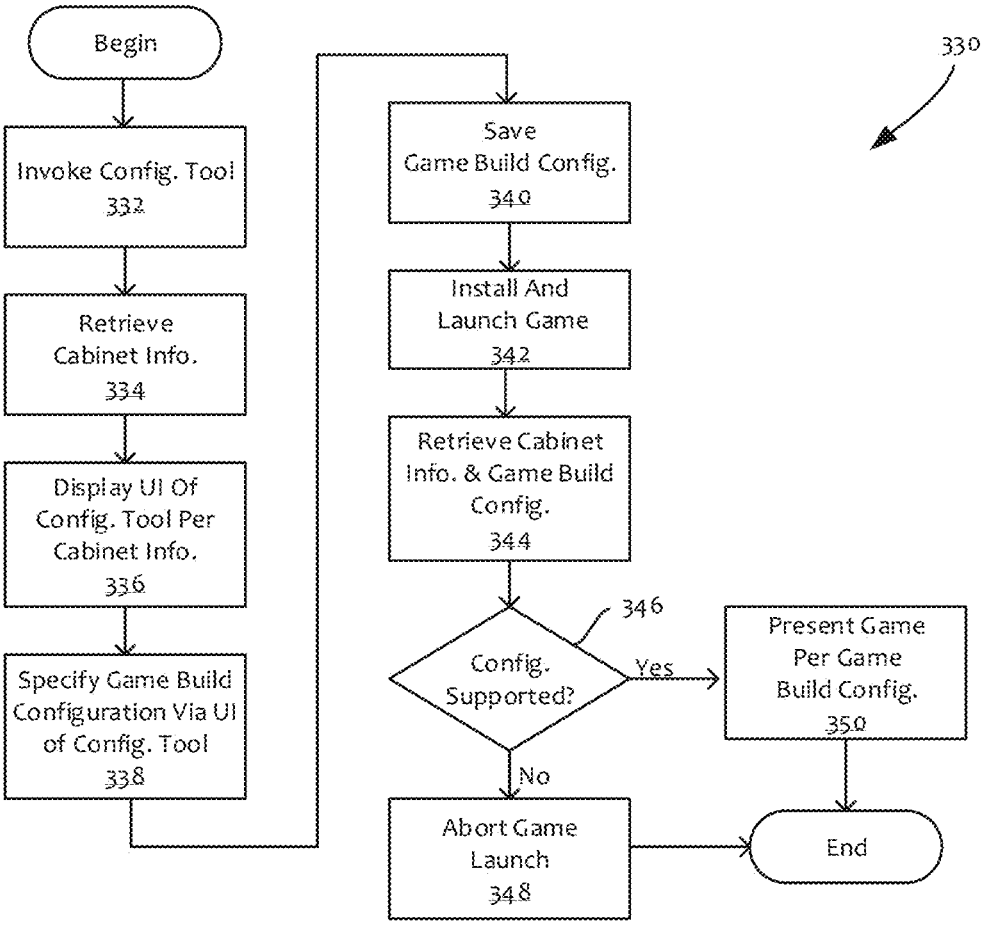
FIG. 3C illustrates a flowchart of an embodiment of a process for configuring a gaming machine having a specific cabinet type to use a multi-cabinet game build.

FIG. 3C illustrates a flowchart of an embodiment of a process 330 for configuring a gaming machine 104 to present a game of a multi-cabinet game build 222. At block 332, authorized personnel, such as a technician, may invoke execution of the configuration tool 212 on the gaming machine 104. In one embodiment, the technician may install a removable storage media or setchip 210 into the gaming machine 104. To this end, the technician may open a locked door 117 and/or remove a panel of the cabinet 116 in order to gain access to the removable storage reader 175. The technician may then insert, attach, or otherwise operably couple the setchip 210 to the removable storage reader 175. In some embodiments, the setchip 210 is in the form of a CompactFlash (CF) card and the removable storage reader 175 includes a CompactFlash (CF) card reader suitable for reading the CF card implemented setchip 210. After installing the setchip 210, the technician may reset or reboot the gaming machine 104 to cause the gaming machine 104 to execute the configuration tool 212 of the setchip 210. Other means of invoking execution of the configuration tool 212 may be employed. For example the configuration tool 212 may be launched via a mobile phone or personal computer, either at the same facility as the gaming machine 104 or at another facility remote from the gaming machine 104.

At block 334, the game controller 150 may retrieve cabinet information for the gaming machine 104. In particular, the cabinet information may describe capabilities of the gaming machine 104 such as, for example, what hardware and software is present, display orientation, display resolution, aspect ratios, and/or capabilities of the gaming machine 104. In some embodiments, the game controller 150 may retrieve the cabinet information via platform code of the setchip 210 and/or the gaming machine 104, which reads the cabinet information from memory 158 and/or non-volatile memory 177. In other embodiments, the game controller 150 may deduce the cabinet information, based on a resolution of the displays 128, 128A, 128B, and/or 139, which may be obtained via platform code of the setchip 210 and/or the gaming machine 104.

Figure 3D:
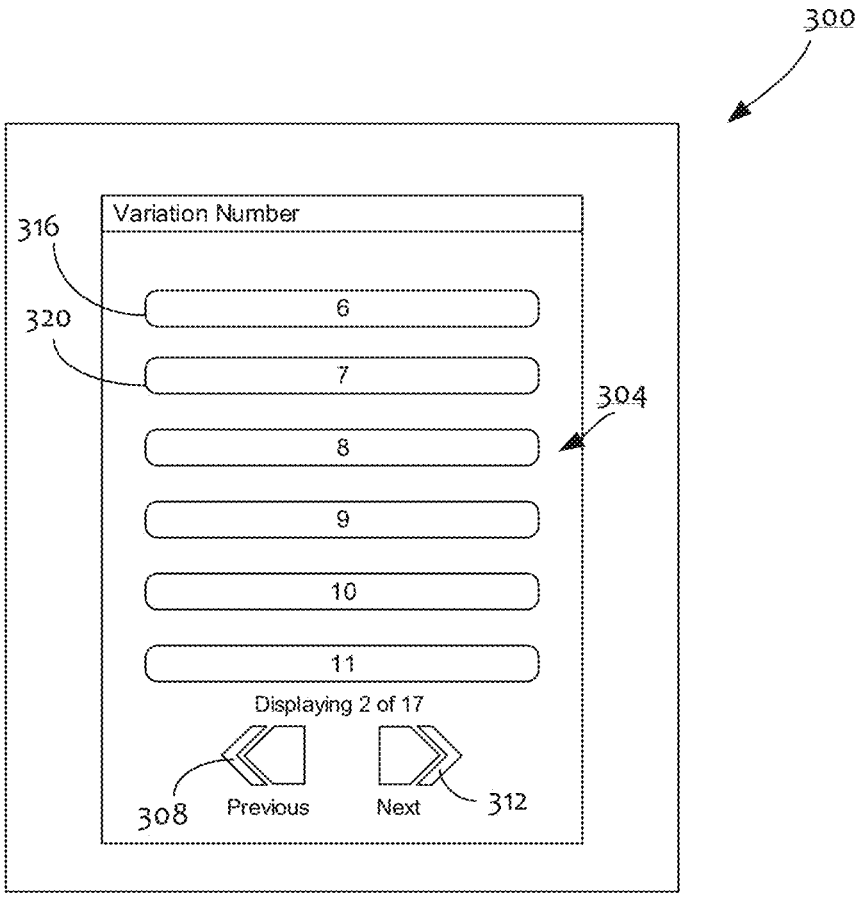
FIG. 3D illustrates an embodiment of the user interface a configuration tool used to configure a gaming machine for a multi-cabinet game build.

At block 336, the game controller 150 may present a user interface 300, as shown in FIG. 3D, of the configuration tool 212. In particular, the game controller 150 may present game build variations and/or options based on the cabinet information. For example, the game controller 150, based on the retrieved cabinet information, may filter out gaming build variations and/or options that are not supported by or otherwise not suitable for the gaming machine 104 due to its cabinet type.

For example, the configuration tool may detect 2 monitors with 1080p resolutions but may not be able to detect their orientation. The options displayed may then only include those related to a 2 monitor setup with 1080p resolution each. The options may also require a selection of which of the 2 monitors is to be used to display the main game display and which is to be used to display bonus game content or other miscellaneous information.

The technician at block 338 may define a specific game build configuration for the gaming machine 104. In particular, the technician may select, via the user interface 300 of the configuration tool 212, game build variations and/or options. As shown in FIG. 3D, the game controller 150 may present a configuration menu of the user interface 300 via a display, e.g., display 128A or 128B, based on the type of cabinet configuration. In such an embodiment, game controller 150 may present the user interface 300 to the technician with a list 304 of the game build variations and/or options supported by and/or otherwise suitable for the gaming machine 104 based on the retrieved cabinet configuration. As shown, the list 304 may include multiple options that are viewable and selectable via backward and forward buttons 308 and 312. The technician via the buttons 308, 312 and the list 304 may define a game build configuration for the gaming machine 104. For example, the technician may create a game build configuration that specifies a particular return to player (RTP) for a particular game to be installed.

As shown in FIG. 3D, the list 304, in one embodiment, may include six options that may be selected by the technician. In such an embodiment, each entry of the list 304 may generally represent a specific game build configuration for a specific cabinet type. For example, the list 304 may include an option 316 that represents a game build configuration for a Helix™ model gaming machine, and an option 320 that represent a game build configuration for a different cabinet type, like an Arc™ model gaming machine. Each option in list 304 may further represent various options that the technician may desire to select for inclusion in the game build configuration, e.g., number of pay lines, bet denominations, bet multipliers, matrix sizes, symbol sets, jackpot levels, RTP options, pay methods, and multiple languages, among other configurations.

At block 340, the game controller 150 may store the specified game build configuration to memory, such as non-volatile memory 177. In this manner, the technician may define a game build configuration for the gaming machine 104 that persists between reboots, resets, and/or power cycles of the gaming machine 104. For example, the technician at 338 may select an option from the list 304, e.g., option 320 which represents, for example, an Arc™ model gaming machine. The game controller 150 via the configuration tool 212 at 340 may save the selected game build configuration to non-volatile memory 177 of the gaming machine 104.

Then, at 342, the technician may install and launch a game of a multi-cabinet game build 222. In one embodiment, the technician may install a removable storage media or game build chip 220 into the gaming machine 104. To this end, the technician may remove the setchip 210 from the removable storage reader 175 and then insert, attach, or otherwise operably couple the game build chip 220 to the removable storage reader 175. In some embodiments, the game build chip 220 like the setchip 210 is in the form of a Compact- Flash (CF) card and the removable storage reader 175 includes a CompactFlash (CF) card reader suitable for reading the CF card implemented game build chip 220. For example, after configuring the gaming machine 104 via the configuration tool 212 of the setchip 210, the technician may remove the setchip 210 from the removable storage reader 175 and install a game build chip 220 with a desired game (e.g., the 8 stripes game manufactured by Aristocrat® Technologies, Inc.) in the removable storage reader 175.

After installing the game build chip 220, the technician may reset or reboot the gaming machine 104 to cause the gaming machine 104 to install and launch the game of the game build chip 220. Other means of invoking execution of the game of the multi-cabinet game build 222 may be employed. For example the multi-cabinet game build 222 may be launched via the network 103 and server computers 102, either at the same facility as the gaming machine 104 or at another facility remote from the gaming machine 104.

In some embodiments, the game controller 150 may respectively transfer game program 226, common assets 227, and tailored assets 228A-228X to memory 158 as game program 156, common assets 164, and tailored assets 166. In some embodiments, the game controller 150 transfers all sets of tailored assets 228A-228 to the tailored assets 166 in memory 158. In other embodiments, the game controller 150 transfers only the set of tailored assets 228A-228X that is specific to the cabinet type of the gaming machine 104. The game controller 150 may also transfer platform code 224 to memory 158 and/or non-volatile memory 177 to provide the gaming machine 104 with a resident copy of the platform code.

For example, during a launch of a game by the Arc™ model gaming machine, common assets 227 (e.g., common artwork, landscape or portrait artwork, and display information) and a set of tailored assets 228A-228X (e.g., content specific for a configuration of the Arc™ model gaming machine) may be transferred to the memory 158 of the gaming machine 104. Additionally, audio assets of the common assets 227 and/or the tailored assets 228A-228X may be automatically configured to be distributed to an available number of channels available on the gaming machine 104, which may include audio assets for various volume control functionality.

At 344, the game controller 150 may retrieve the cabinet information and the game build configuration. In particular, the game controller 150, via platform code 224 of the game build chip 220 and/or platform code already resident in the gaming machine 104, may retrieve the cabinet information in a manner similar to that describe above with respect to 334. Moreover, the game controller 150 via the platform code may also retrieve the game build configuration from the non-volatile memory 177.

At block 346, the game controller 150 may determine, based on the retrieved cabinet information, whether the retrieved game build configuration is supported by and/or otherwise compatible with the gaming machine 104. For example, the game controller 150 may determine whether the cabinet type specified by the game build configuration corresponds to the cabinet type specified by the retrieved cabinet information. More specifically, the game controller 150 may determine whether the gaming machine 104 includes a landscape display when the game build configuration specifies content specifically for a landscape display, like that of the Helix™ model gaming machine. Similarly, the game controller 150 may determine whether the gaming machine 104 includes a portrait display when the game build configuration specifies content specifically for a portrait display, like that of the Arc™ model gaming machine.

If the game controller 150 determines that the retrieved cabinet information does not match the retrieved game build configuration, the game controller 150 at 348 may provide the technician with an indication that the game launch failed. For example, the game controller 150 via a display 128A, 128B may present an appropriate error message to the technician. In response to such an error message, the technician may reinstall the setchip 210 in order to update the stored game build configuration to a game build configuration supported by the gaming machine 104. In this manner, the technician, via the configuration tool 212, may appropriately update the game build configuration stored in the non-volatile memory 177 so as to permit successful installation and launching of the game of the multi-cabinet game build 222.

On the other hand, if the game controller 150 determines that the cabinet information matches the retrieved game build configuration, the game controller 150 at 350 may present a game of the multi-cabinet game build 222 on display 128A, 128B. In particular, the game controller 150 may execute the game program 156 per the assets 164, 166 in memory 158. As a result, game-side hardcoding of display configurations may not be necessary.

As should be apparent, the process 330 of FIG. 3C may permit a multi-cabinet game build 222 to be deployed across gaming machines of cabinet types with different display configurations (e.g., different screen sizes, resolution and aspect ratios). This, in turn, allows game developers the ability to use common assets 227 across a range of cabinet form-factors and display configurations, while still being able to deliver a high aesthetic quality of art content that is native for a given cabinet type. Employing such a multi-cabinet game build 222 across multiple cabinet types may reduce product development cycles, allow for more games to be available across a wider-range of cabinet types, and reduce the time for game revision updates.

Embodiments of the present invention may be further extended to exploit the play of features of the same multi-cabinet game build depending on the cabinet type on which the multi-cabinet game build is loaded. For example, FIGS. 4A-8B illustrate how play of a game for a specific cabinet type may employ features, assets, logic, etc. of the game that depend on the cabinet type on which the game is played. The game 404 illustrated is the 8 Stripes game manufactured by Aristocrat® Technologies, Inc. and shows a portion of game artwork.

Figure 4A:
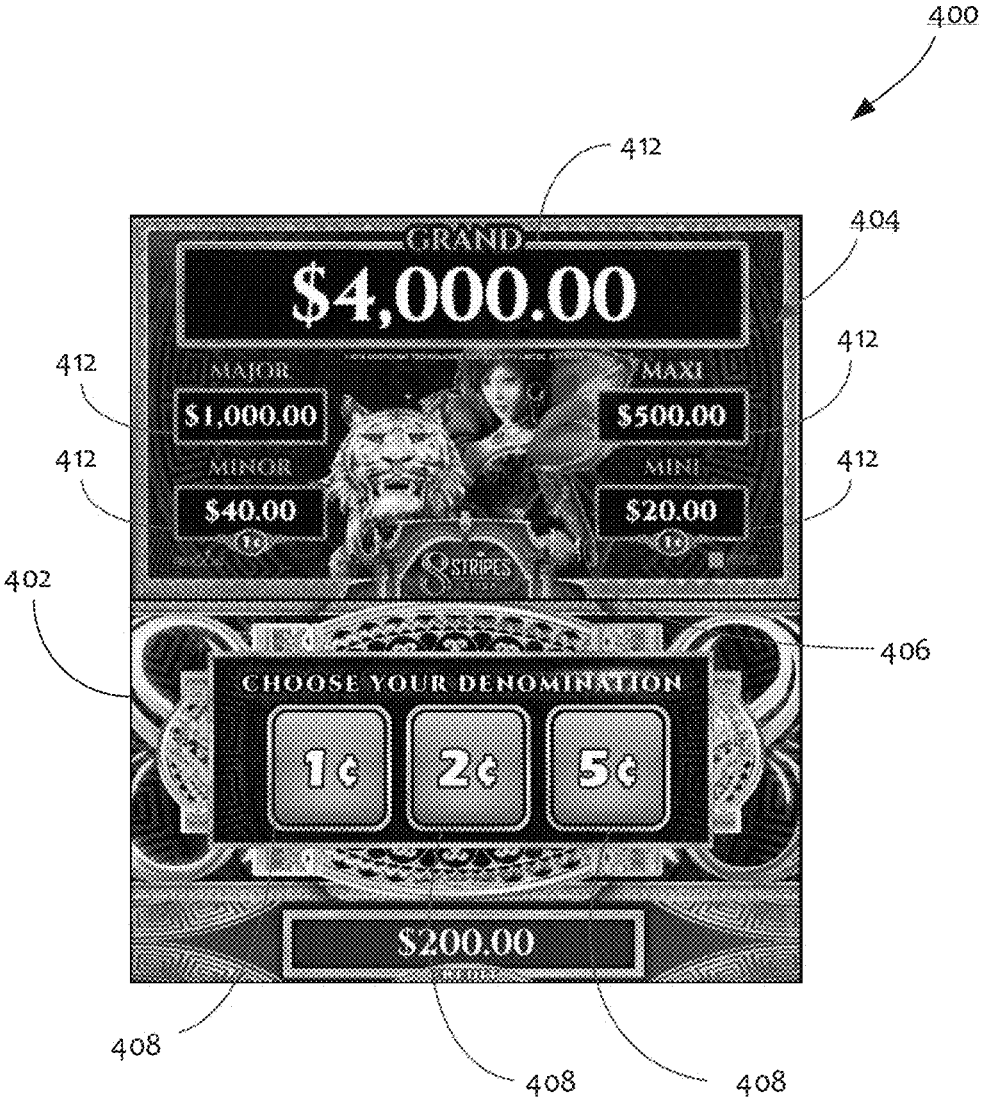
FIG. 4A illustrates an embodiment of a lobby screenshot of a game on a gaming machine having a first cabinet type.

Referring to FIG. 4A illustrates an embodiment of a lobby screenshot 400 on a cabinet type with landscape-style primary displays 128A. Specifically, lobby screenshot 400 displays on a first display 402 of a first cabinet, such as the gaming machine 104C of FIG. 1 of a game 404, which represents a Helix™ model gaming machine. The Helix™ model gaming machine has two landscape style displays. The game 404 illustrated is the 8 Stripes game manufactured by Aristocrat® Technologies, Inc. and shows a portion of game artwork 406. The lobby screenshot 400 shows a plurality of denominations 408 selectable by a player in the game 404, and a plurality of jackpot prizes 412 winnable by the player.

Figure 4B:
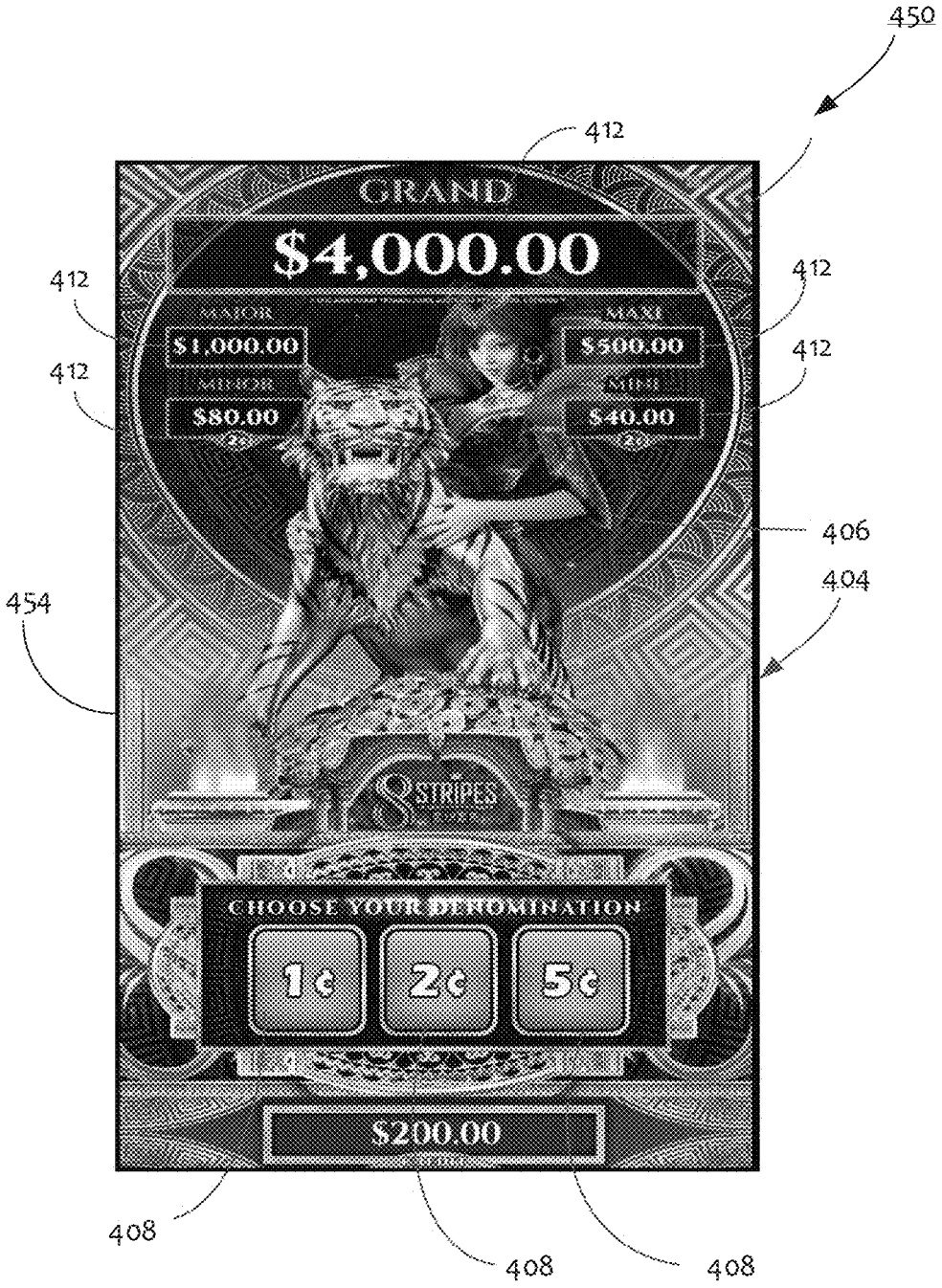
FIG. 4B illustrates an embodiment of the lobby screenshot of the game on a gaming machine having a second cabinet type.

FIG. 4B illustrates an embodiment of a second lobby screenshot 450 on a cabinet type with portrait-style primary displays 128. Like reference numerals in FIG. 4B refer to like items in FIG. 4A, and vice versa. Specifically, second lobby screenshot 450 of the game 404 displays on a second cabinet, such as the gaming machine 1048 of FIG. 1, which represents an Arc™ model gaming machine. The Arc™ model gaming machine has a portrait style display that has expanded artwork for the same game build on the landscape cabinet type of FIG. 4A. Specifically, the second lobby screenshot 450 similarly shows the 8 Stripes game manufactured by Aristocrat® Technologies, Inc. However, the second lobby screenshot 450 shows a larger portion of the game artwork 406, while displaying the plurality of denominations 408 selectable by a player and the plurality of jackpot prizes 412 winnable by the player. Thus, the first lobby screenshot 400 and the second lobby screenshot 450 may utilize common assets for certain aspects (e.g., artwork for the plurality of denominations 408 and upper portion of the game artwork 406) and tailored assets for other aspects (e.g., the lower portion of the game artwork 406 for the second lobby screenshot 450).

Figure 5A:
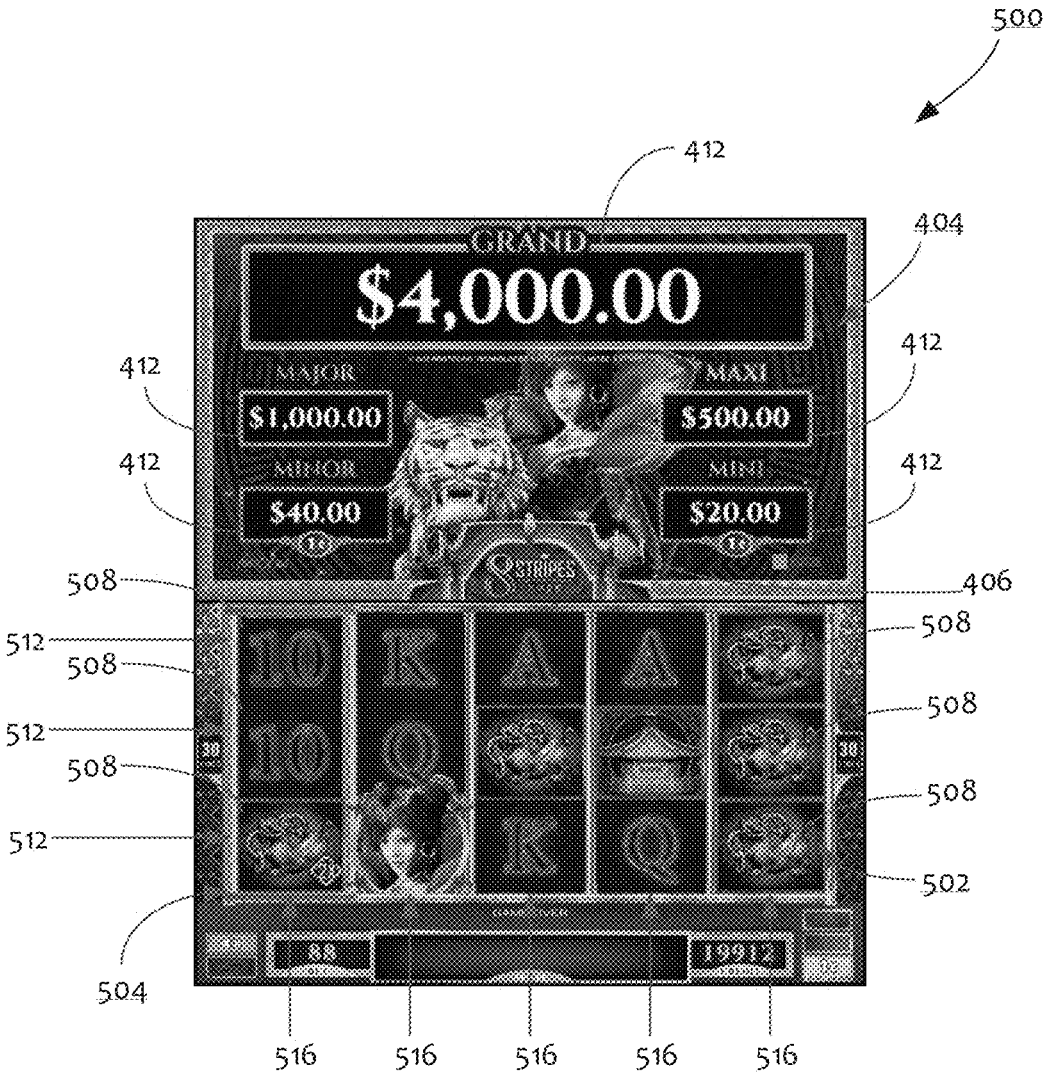
FIG. 5A illustrates an embodiment of a base game screenshot on a gaming machine having the first cabinet type.

FIG. 5A illustrates an embodiment of a base game screenshot 500 of the game 404 on the first cabinet represented by gaming machine 104C having a landscape orientation for the game build. Base game screenshot 500 shows a base game 502 having a matrix 504 of display positions 508. In this embodiment, the base game 502 of FIG. 5A is a spinning reel game having the matrix 504. The matrix 504 has three (3) rows 512 and five (5) columns 516 of display positions 508. Each of the display positions 508 is occupied by one or more symbols. As such, the matrix 504 has a total of 15 symbols.

Figure 5B:
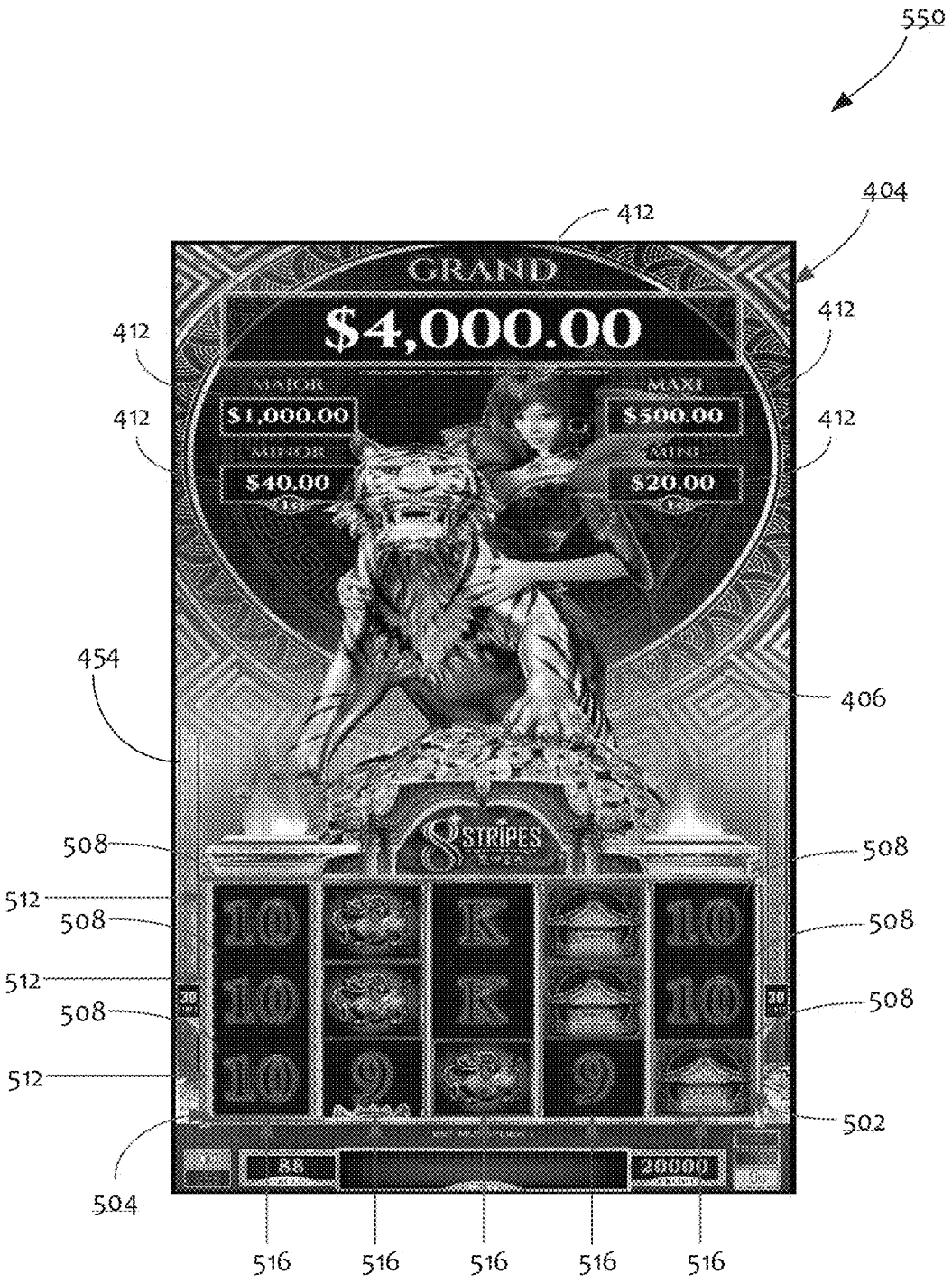
FIG. 5B illustrates an embodiment of the base game screenshot on a gaming machine having the second cabinet type.

FIG. 5B illustrates an embodiment of a base game screenshot 550 of the game 404 on the second cabinet represented by gaming machine 104B having a portrait orientation. Like reference numerals in FIG. 5B refer to like items in FIG. 5A, and vice versa. The base game screenshot 550 similarly shows the matrix 504 that has a total of 15 symbols arranged in three (3) rows 512 and five (5) columns 516. In such a game build configuration for game 404, the reels may include expanding reels (e.g., up to 6 reels high or a 6×5 matrix) (not shown in FIG. 5B) that may also have a defined RTP. In this embodiment, the expanding reel feature would be disabled for the game build configuration for the landscape cabinet type. In this embodiment, the Arc™ model gaming machine 104B has a portrait style display that has common assets 227 such as artwork, functionality, and audio/visual features from the multi-cabinet game build 222 that are also used by the landscape cabinet type of FIG. 5A, but also includes tailored assets (e.g., artwork and game logic for the expanding reels) that still exploit the portrait display orientation of the gaming machine 104B for cabinet type specific features.

Figure 6A:
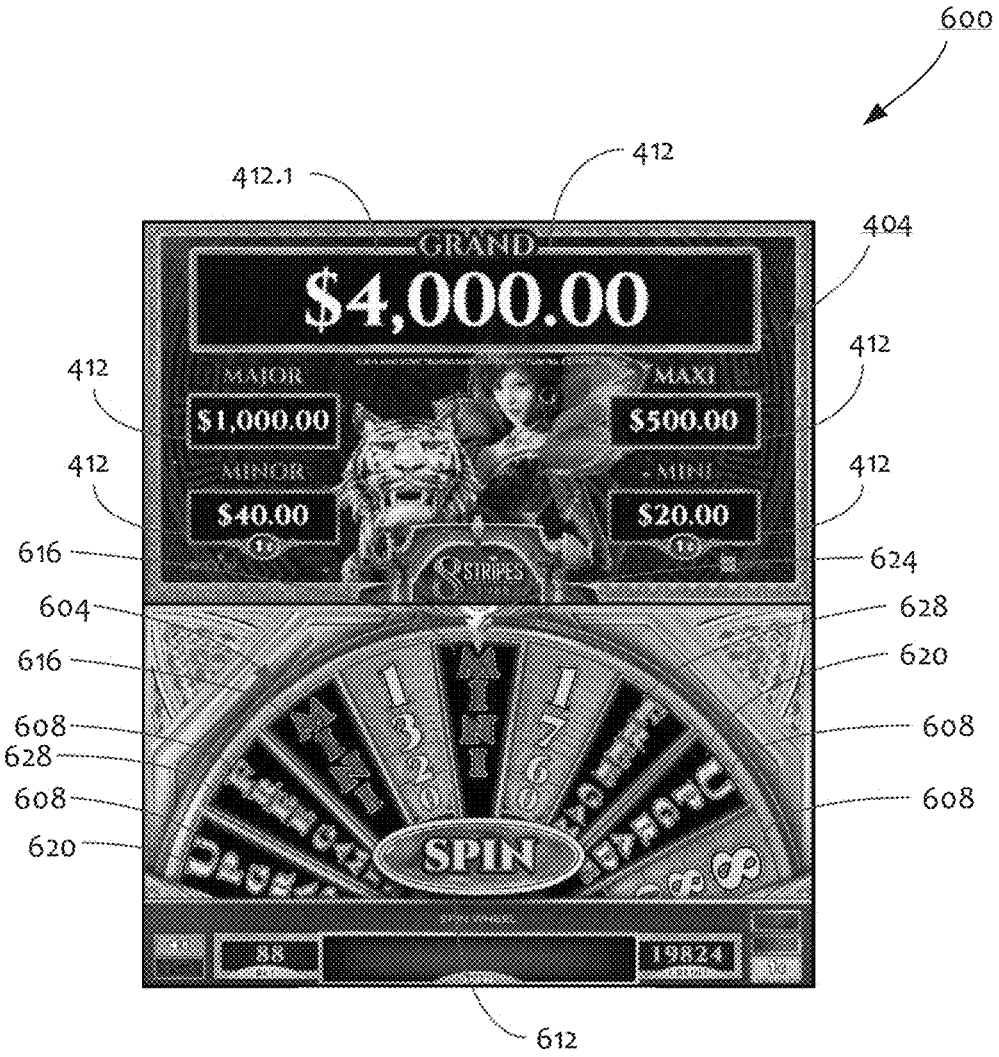
FIG. 6A illustrates an embodiment of a wheel feature screenshot on a gaming machine having the first cabinet type.
Figure 6B:
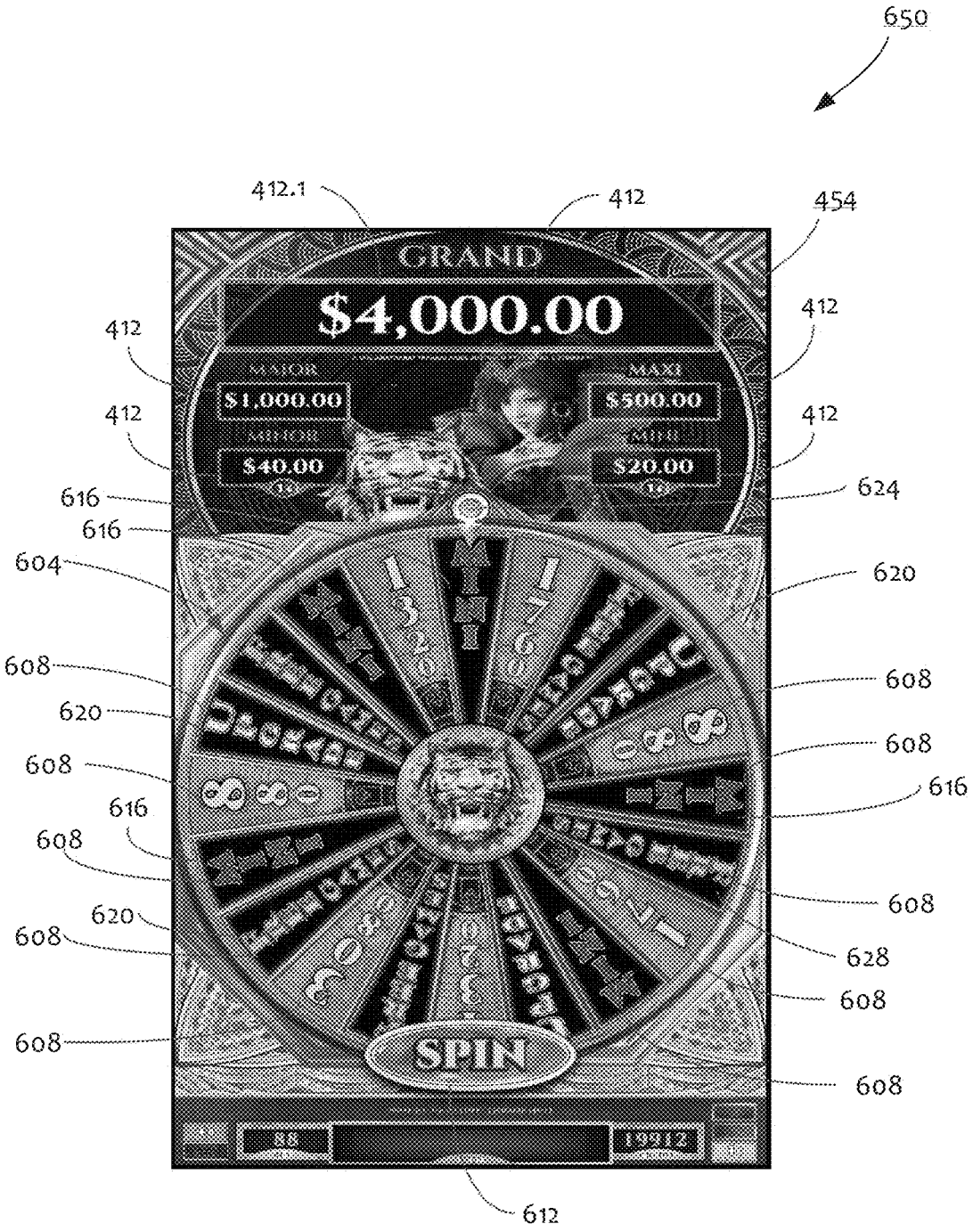
FIG. 6B illustrates an embodiment of the wheel feature screenshot on a gaming machine having the second cabinet type.

FIGS. 6A-6B illustrate a screenshot of a wheel feature game that is triggered when a predetermined number, for example, three (3) or more, of wheel symbols (not shown) or other predetermined symbols are displayed in the matrix 504 of FIG. 5A or FIG. 5B. For example, FIG. 6A illustrates a wheel feature game screenshot 600 of the game 404 on the first cabinet represented by gaming machine 104C having a landscape orientation for the game build. Specifically, wheel feature game screenshot 600 shows a wheel 604 on the first cabinet represented by gaming machine 104C that has been triggered from game 404. The wheel 604 has a number of slices 608. As shown, the wheel feature game screenshot 600 shows nine (9) slices of the wheel 604 and includes a spin button 612. Each of the slices 608 has a starting value. In some cases, starting values on the slices 608 are determined by a number of wheel symbols that are used to trigger the wheel feature. In some cases, when more wheel symbols are used to trigger the wheel feature, the starting values may include greater values or jackpots. For example, when the wheel feature is triggered with three (3) wheel symbols, jackpot values available on the wheel 604 may include mini jackpots 616 as shown. If the wheel feature is triggered with four (4) or five (5) wheel symbols, jackpot values available on the wheel 604 may include minor jackpots and maxi jackpots, respectively.

After a spin, if the wheel 604 lands on an upgrade slice 620 as pointed to by indicator 624, some or all of the values on the slices 608 are transformed. For example, the mini jackpot 616 may be transformed, incremented, or upgraded into a minor jackpot. Thereafter, the wheel 604 spins again. If the wheel 604 lands on another upgrade slice 620, the wheel 604 is transformed, incremented, or upgraded again, as discussed above. If the wheel 604 lands on a grand jackpot slice whose value is shown in Grand prize 412.1, the upgrade slices 620 are replaced by other prizes, for example, non-jackpot prizes. If the wheel 604 lands on a slice that has a jackpot and a secondary non-jackpot prize, such as, credits and free games, the jackpot is awarded first followed by the non-jackpot secondary prize. Thus, a player may be awarded a jackpot, a number of free games, credit awards, jackpot and credit awards, or jackpot and a number of free games. Although, as shown, a jackpot may be awarded through the wheel 604, a jackpot may also be awarded through a mystery prize feature. A Mystery Prize may also be awarded based on a random credit prize or jackpot awarded on a random spin in the base or bonus free game. As shown, only one (1) jackpot level is available on the wheel 604 at a time. However, in some other embodiments, the wheel 604 may include a predetermined number of jackpot levels.

FIG. 6B illustrates an embodiment of a wheel game feature of the game 404 on the second cabinet represented by gaming machine 1048 having a portrait orientation. Like reference numerals in FIG. 6B refer to like items in FIG. 6A, and vice versa. Specifically, a second wheel feature screenshot 650 shows the wheel 604 on the second cabinet represented by gaming machine 1048. As discussed above, the second display 454 is a portrait style display, which is larger than the first display 402. As such, the second wheel feature screenshot 650 shows the wheel 604 in its entirety. That is, all 20 slices of the wheel 604 are displayed on the second display 454. Showing the wheel 604 in its entirety allows a player to see his/her chances of the wheel 604 landing on a desirable slice and its corresponding prize. In this embodiment, the Arc™ model gaming machine 1048 has a portrait style display that has common assets 227 such as artwork, functionality, and audio/visual features that are also used by the landscape cabinet type of FIG. 6A, but also includes tailored assets (e.g., artwork and game logic for the lower portion of wheel 604) that still exploit the portrait display orientation of the gaming machine 1048 for cabinet type specific features.

Since the first cabinet (e.g., represented by gaming machine 104C) and the second cabinet (e.g., represented by gaming machine 104B) have different displays, display orientations, hardware (e.g., graphics controllers) and/or player interface configurations, some or all features of the game 404 may be enabled or disabled based on the game build configuration for the cabinet selected from the list 304 via the user interface 300 of FIG. 3D.

Figure 7A:
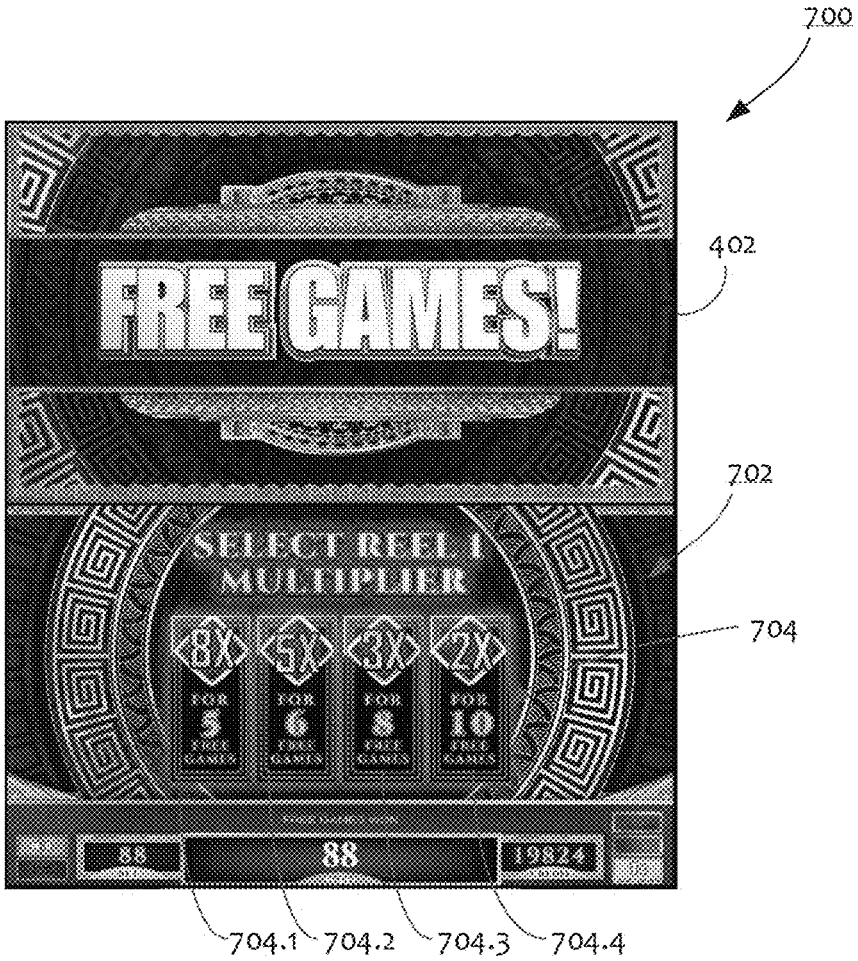
FIG. 7A illustrates an embodiment of a first free game selection screenshot on a gaming machine having the first cabinet type.

For example, FIG. 7A illustrates an embodiment of a free game feature of the game 404 on the first cabinet represented by gaming machine 104C having a landscape orientation for the game build. The first free game selection screenshot 700 on the first cabinet shows a first free game selection triggered by the free game slice 628 on the wheel 604. In this embodiment, a free game feature based on expanding the matrix 504 is disabled based at least in part on the first display 402 of the first cabinet represented by the Helix™ model gaming machine that has two landscape style displays.

When a specific free game feature is disabled, other free game features may be enabled or deployed. For example, a free game feature based on a multiplier free game feature 702 may be enabled in place of a free game feature based on matrix expansions. As shown, the multiplier free game feature 702 includes a plurality of free game options 704 selectable by a player, including free game option 704.1 having a 8× multiplier and five (5) free games, free game option 704.2 having a 5× multiplier and six (6) free games, free game option 704.3 having a 3× multiplier and eight (8) free games, and free game option 704.4 having a 2× multiplier and ten (10) free games. Thus, the number of free games awarded is dependent on the multiplier selected. In some embodiments, the free game feature may use a different symbol set than the base game, including wild symbols, mini jackpots, minor jackpots, maxi jackpots, and major jackpots, and wheel symbols (e.g., for free game re-triggers), but without any royal symbols.

Figure 7B:
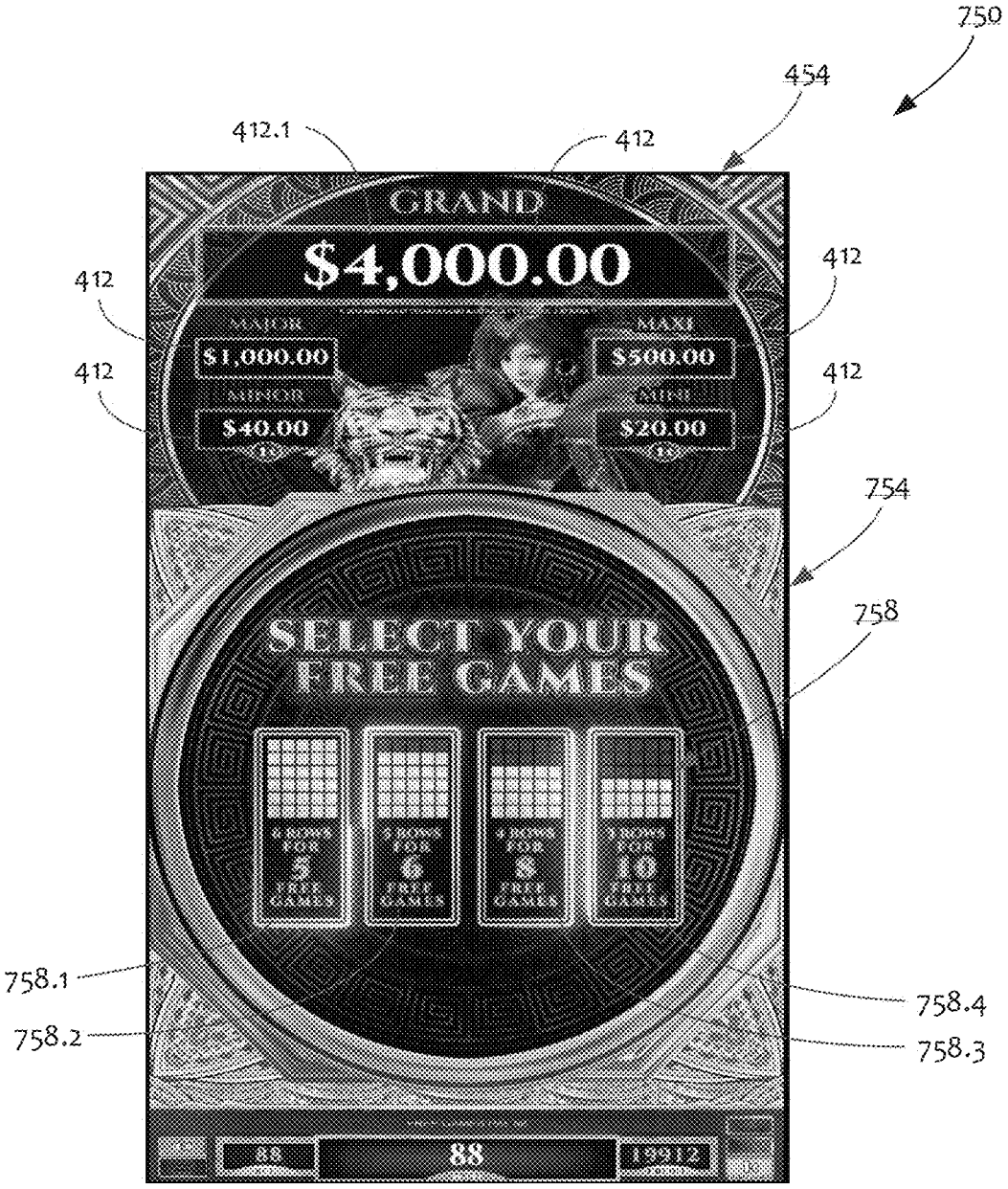
FIG. 7B illustrates an embodiment of a second free game selection screenshot on a gaming machine having the second cabinet type.

A free game feature based on expanding the matrix 504 may be enabled or deployed based at least in part on the second display 454. For example, FIG. 7B illustrates a free game feature of the game 404 on the first cabinet represented by gaming machine 1048 having a portrait orientation. Like reference numerals in FIG. 7B refer to like items in FIG. 7A, and vice versa. Similar to the first free game selection, the second free game selection screenshot 750 shows a second free game that is triggered by a free game slice 628 on the wheel 604. Since the second display 454 is relatively larger than the first display 402, and has a portrait profile, a free game feature based on expanding the matrix 504 may be available or deployed via the second free game.

As shown, the second free game selection includes a matrix expansion free game feature 754 and a plurality of matrix expansion options 758 selectable by a player. The matrix expansion options 758 includes expansion option 758.1 that adds six (6) rows of display positions to the matrix 504 and provides five (5) free games, expansion option 758.2 that adds five (5) rows of display positions to the matrix 504 and provides six (6) free games, expansion option 758.3 that adds four (4) rows of display positions to the matrix 504 and provides eight (8) free games, and expansion option 758.4 that adds three (3) rows of display positions to the matrix 504 and provides ten (10) free games. In this embodiment, the Arc™ model gaming machine 1048 has a portrait style display that has common assets 227 such as artwork, functionality, and audio/visual features that are also used by the landscape cabinet type of FIG. 7A, but still exploits the portrait display orientation of the gaming machine 1048 for cabinet type specific features.

Figure 8A:
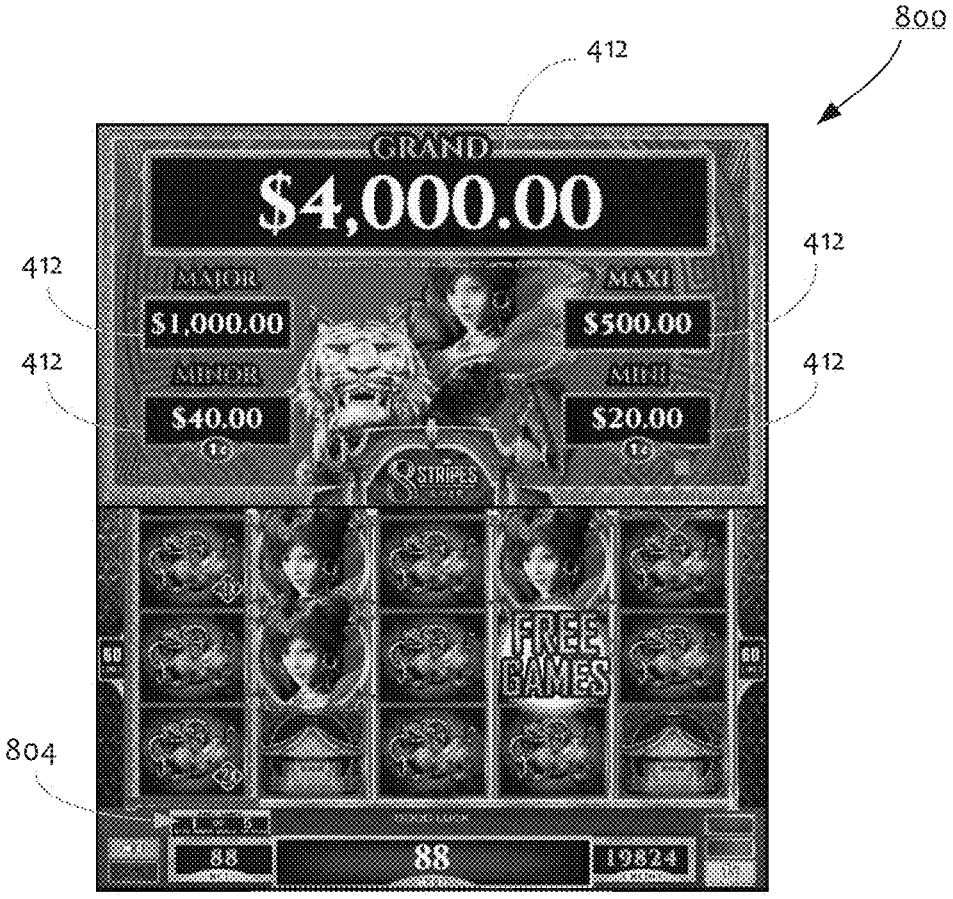
FIG. 8A illustrates an embodiment of the first free game screenshot on a gaming machine having the first cabinet type.

FIG. 8A illustrates an embodiment of a first free game screenshot 800 of the multiplier free game feature 702 on the first display 402. As discussed above, the free game feature may be triggered in response to three (3) or more wheel symbols being displayed in the base game 502, or when the indicator 624 of FIG. 6A points to the free game slice 628. In some embodiments, the free game feature is accumulative. That is, if the free game feature is awarded, a player may be awarded a fixed number of additional free games, and additional free games are added directly to a free game meter 804. For example, if a player was awarded ten free games, has played six free games, and is again awarded five free games, the player is now playing a seventh free game among fifteen free games. As shown, the free game meter 804 indicates that the player was awarded five free games, and has already played one of the five free games.

Figure 8B:
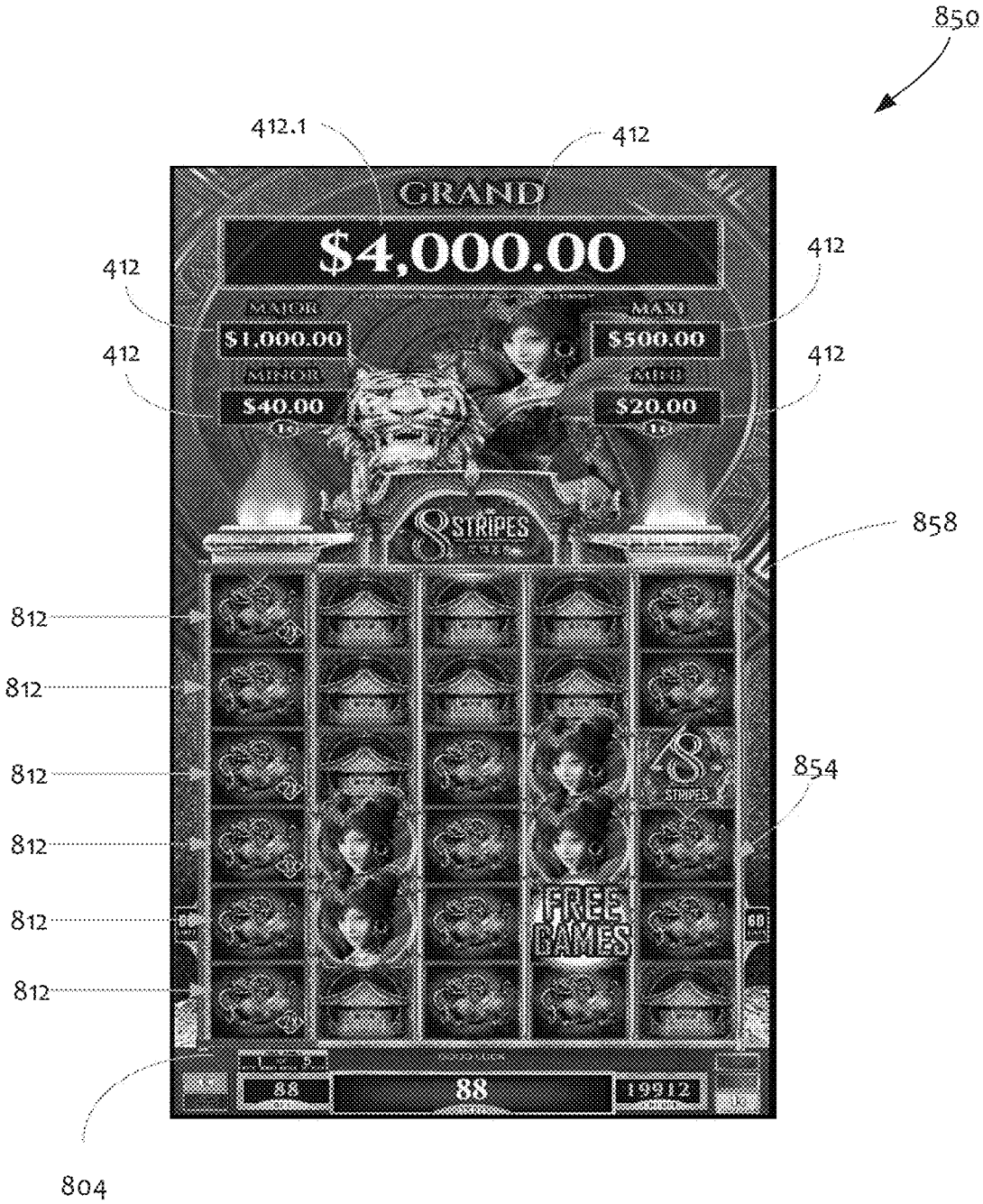
FIG. 8B illustrates an embodiment of the second free game screenshot on a gaming machine having the second cabinet type.

FIG. 8B illustrates an embodiment of a second free game feature of the game 404 on the first cabinet represented by gaming machine 1048 having a portrait orientation for the game build. Like reference numerals in FIG. 8B refer to like items in FIG. 8A, and vice versa. Specifically, FIG. 8B illustrates a second free game screenshot 850 showing a matrix expansion free game feature 854 on the second display 454. The second free game screenshot 850 shows an expanded matrix 858 which is derived from expanding the matrix 504 from three rows 512 to six rows 812. In such a game build configuration for game 404, the reels may include expanding reels (e.g., up to 6 reels high or a 6×5 matrix) that may also have a defined RTP. The expanding reel feature would not typically be available for the game build configuration for the landscape cabinet type. In certain embodiments, for example, the first cabinet type represented by gaming machine 1048 could share a portion of the same real matrix as the second cabinet represented by gaming machine 104C (compare the bottom three rows of FIG. 8B (portrait display) with the three reel rows of FIG. 8A), which is a benefit of the common or shared assets 227 between cabinet types. In this embodiment, the Arc™ model gaming machine 1048 has a portrait style display that has common assets 227 such as artwork, functionality, and audio/visual features that are also used by the landscape cabinet type of FIG. 8A, but also tailored assets (e.g., artwork and game logic for the expanding reels) that still exploit the portrait display orientation of the gaming machine 104B for cabinet type specific features.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A gaming machine comprising:

a display device;

a game controller;

memory storing game program instructions and other instructions, the memory including non-volatile memory that stores a game build configuration;

a removable storage reader; and removable storage media coupled to the removable storage reader, the removable storage media storing:

common assets used by a first gaming machine configuration and a second gaming machine configuration;

first assets tailored for the first gaming machine configuration; and second assets tailored for the second gaming machine configuration;

wherein execution of the other instructions, causes the game controller to at least:

determine that the game build configuration corresponds to the first gaming machine configuration or the second gaming machine configuration; and select the first assets or the second assets per the game build configuration to obtain selected assets that are tailored for the gaming machine; and wherein execution of game program instructions, causes the game controller to at least present a game and game outcomes of the game on the display device per the common assets and the selected assets tailored for the gaming machine.

2. The gaming machine of claim 1, wherein execution of the other instructions further causes the game controller to read the game program instructions from the removable storage media and store the game program instructions to the memory.

3. The gaming machine of claim 1, wherein execution of the other instructions further causes the game controller to store the common assets and the selected assets to the memory.

4. The gaming machine of claim 1, wherein the game controller is further configured to initiate execution of the game program instructions from the memory after determining that the game build configuration stored in the non-volatile memory is supported.

5. The gaming machine of claim 1, wherein the common assets include paytables used by the first gaming machine configuration and the second gaming machine configuration.

6. The gaming machine of claim 1, wherein the selected assets include artwork tailored for an orientation of the display device.

7. The gaming machine of claim 1, wherein the selected assets include reelstrips tailored for the display device.

8. The gaming machine of claim 1, wherein the selected assets include audio assets tailored for the gaming machine.

9. The gaming machine of claim 1, wherein the game build configuration includes game build options selected from one or more of: number of pay lines, bet denominations, bet multipliers, matrix sizes, symbol sets, jackpot levels, return-to-player (RTP) options, pay methods, languages, display size, display resolution, aspect ratios, and game features.

10. A method of configuring a gaming machine, the method comprising:

presenting, on a display device of the gaming machine, a user interface of a configuration tool;

receiving, via the user interface of the configuration tool, selections that specify a game build configuration for a game of the gaming machine;

storing the game build configuration in a non-volatile memory of the gaming machine;

reading a game build of the game from a storage media, the game build comprising common assets and sets of tailored assets, wherein the common assets are common to multiple gaming machine configurations and each set of tailored assets provides assets tailored for a respective gaming machine configuration;

transferring, to a memory of the gaming machine per the game build configuration stored in the non-volatile memory of the gaming machine, the common assets and a set of tailored assets tailored for the respective gaming machine configuration of the gaming machine; and executing the game per the common assets and the set of tailored assets transferred to the memory of the gaming machine.

11. The method of claim 10, further comprising determining that the gaming machine and the game build support the game build configuration prior to executing the game.

12. The method of claim 10, wherein transferring the common assets and the set of tailored assets transfers the common assets and the set of tailored assets to the non-volatile memory of the gaming machine.

13. The method of claim 10, further comprising:

retrieving artwork from the common assets; and retrieving artwork from the set of tailored assets that is specific to an orientation of the display device.

14. The method of claim 10, further comprising retrieving audio assets from the set of tailored assets.

15. The method of claim 10, wherein presenting the user interface includes presenting game build options that include options for one or more of: number of pay lines, bet denominations, bet multipliers, matrix sizes, symbol sets, jackpot levels, return-to-player (RTP) options, pay methods, languages, display size, display resolution, aspect ratios, and game features.

16. A non-transitory computer readable storage medium comprising instructions, that in response to being executed, cause a gaming machine to:

present, on a display device of the gaming machine, a user interface of a configuration tool;

receive, via the user interface of the configuration tool, selections that specify a game build configuration for a game of the gaming machine;

store the game build configuration in a non-volatile memory of the gaming machine;

read a game build of the game from a storage media, the game build comprising common assets and sets of tailored assets, wherein the common assets are common to multiple gaming machine configurations and each set of tailored assets provides assets tailored for a respective gaming machine configuration; and transfer, to a memory of the gaming machine per the game build configuration stored in the non-volatile memory of the gaming machine, the common assets and a set of tailored assets tailored for the respective gaming machine configuration of the gaming machine and configure the gaming machine for execution of the game per the common assets and the set of tailored assets transferred to the memory of the gaming machine.

17. The non-transitory computer readable storage medium of claim 16, wherein the instructions, in response to being executed, configure the gaming machine to determine that the gaming machine and the game build support the game build configuration prior to executing the game.

18. The non-transitory computer readable storage medium of claim 16, wherein the instructions, in response to being executed, cause the gaming machine to transfer the common assets and the set of tailored assets to the non-volatile memory of the gaming machine.

19. The non-transitory computer readable storage medium of claim 16, wherein the instructions, in response to being executed, cause the gaming machine to:

retrieve artwork from the common assets;

retrieve artwork from the set of tailored assets that is specific to an orientation of the display device; and retrieve audio assets from the set of tailored assets.

20. The non-transitory computer readable storage medium of claim 16, wherein the instructions, in response to being executed, cause the gaming machine to present, via the user interface, game build options that include options for one or more of: number of pay lines, bet denominations, bet multipliers, matrix sizes, symbol sets, jackpot levels, return-to-player (RTP) options, pay methods, languages, display size, display resolution, aspect ratios, and game features.

* * * * *